US011359411B2

(12) United States Patent
Talpe

(10) Patent No.: US 11,359,411 B2
(45) Date of Patent: Jun. 14, 2022

(54) SURFACE-MOUNTABLE ELECTRIC STRIKE

(71) Applicant: LOCINOX, Waregem (BE)

(72) Inventor: Joseph Talpe, Heestert-Zwevegem (BE)

(73) Assignee: LOCINOX, Waregem (BE)

( * ) Notice: Subject to any disclaimer, the term of this patent is extended or adjusted under 35 U.S.C. 154(b) by 911 days.

(21) Appl. No.: 16/017,885

(22) Filed: Jun. 25, 2018

(65) Prior Publication Data

US 2018/0371796 A1 Dec. 27, 2018

(30) Foreign Application Priority Data

Jun. 26, 2017 (EP) ..... 17177943

(51) Int. Cl.
*E05B 47/00* (2006.01)
*E05B 47/06* (2006.01)
(Continued)

(52) U.S. Cl.
CPC ..... *E05B 47/0047* (2013.01); *E05B 47/0002* (2013.01); *E05B 47/0006* (2013.01);
(Continued)

(58) Field of Classification Search
CPC ..... E05B 47/0047; E05B 47/0002; E05B 47/0006; E05B 47/0607; E05B 65/0007;
(Continued)

(56) References Cited

U.S. PATENT DOCUMENTS 353,263 A 11/1886 Lüngen
5,988,711 A * 11/1999 Toma ..... E05B 47/0047 292/201
(Continued)

FOREIGN PATENT DOCUMENTS

DE 197 07 759 C1 8/1998
DE 10116299 C1 * 10/2002 ..... E05B 47/0047
(Continued)

OTHER PUBLICATIONS

Extended European Search Report dated Dec. 21, 2017, issued in corresponding European Application No. 17177943.2, filed Jun. 26, 2017, 6 pages.

*Primary Examiner* — Kristina R Fulton
*Assistant Examiner* — James Edward Ignaczewski
(74) *Attorney, Agent, or Firm* — Christensen O'Connor Johnson Kindness PLLC

(57) ABSTRACT

A surface-mountable electric strike having a keeper arranged to pivot about a first shaft extending in a longitudinal direction; a lock lever for locking the keeper in a door-locking position, the lock lever being arranged to pivot about a second shaft extending in a direction that is transverse to the longitudinal direction and parallel to the backside of the strike; and an actuation mechanism for actuating the lock lever, the actuation mechanism comprising an electromagnet that is situated next to the lock lever in a direction which is substantially perpendicular to the backside of the strike thereby enabling the electromagnet to act directly upon the lock lever providing a simple construction. Moreover, the orientation of the second shaft enables arranging the lock lever, and the electromagnet, above and/or underneath the keeper, thereby reducing the total depth of the strike.

13 Claims, 18 Drawing Sheets

(51) Int. Cl.
*E05B 65/00* (2006.01)
*E05B 63/04* (2006.01)

(52) U.S. Cl.
CPC ..... *E05B 47/0607* (2013.01); *E05B 65/0007* (2013.01); *E05B 63/04* (2013.01); *E05B 2047/0073* (2013.01); *E05B 2047/0076* (2013.01)

(58) Field of Classification Search
CPC .. E05B 65/06; E05B 63/04; E05B 2047/0073; E05B 2047/0076; Y10T 292/68; Y10T 292/696; Y10T 292/699; Y10T 292/702
See application file for complete search history.

(56) References Cited

U.S. PATENT DOCUMENTS

| | | | | |
|---|---|---|---|---|
| 6,966,585 | B2 * | 11/2005 | Egi | E05B 47/0047 292/144 |
| 7,722,097 | B2 * | 5/2010 | Schnarr | E05B 47/0047 292/341.16 |
| 2006/0097525 | A1 * | 5/2006 | Toma | E05B 47/0047 292/341.16 |
| 2017/0073998 | A1 * | 3/2017 | Fang | E06B 9/04 |

FOREIGN PATENT DOCUMENTS

| | | | |
|---|---|---|---|
| DE | 10 2013 103 474 | A1 | 10/2014 |
| EP | 1 907 712 | B1 | 12/2008 |
| EP | 3 109 381 | A1 | 12/2016 |

* cited by examiner

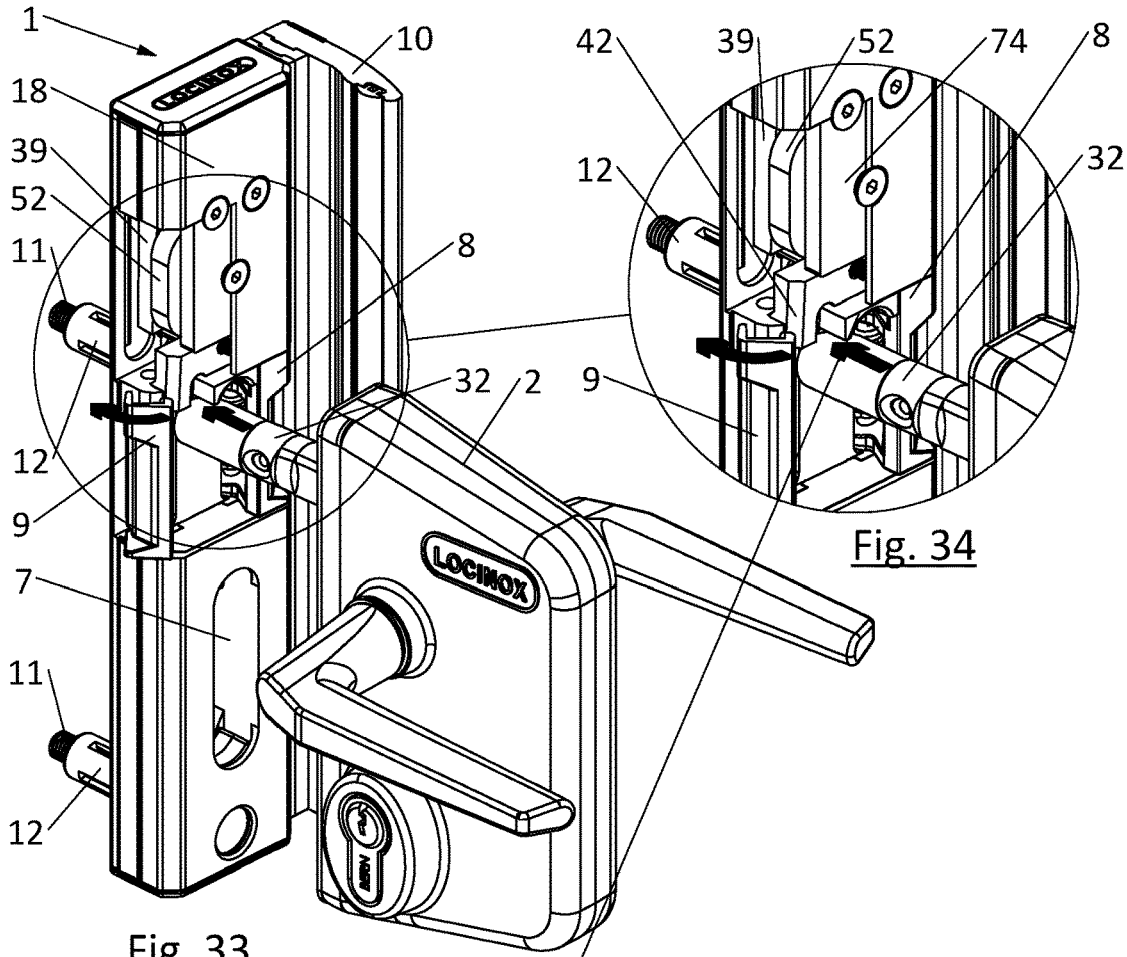
Fig. 34
Fig. 33
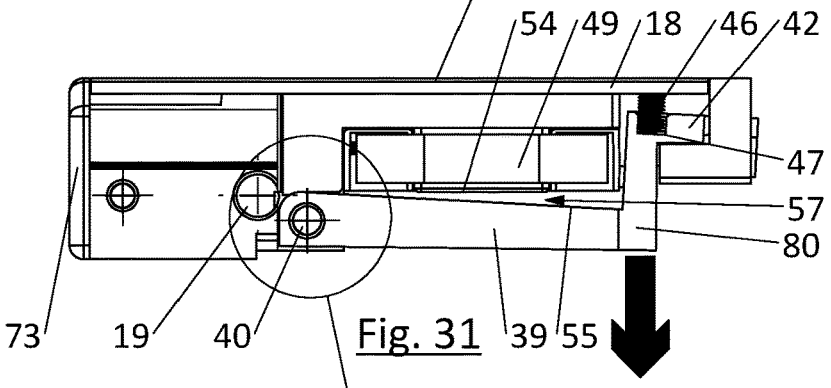
Fig. 31
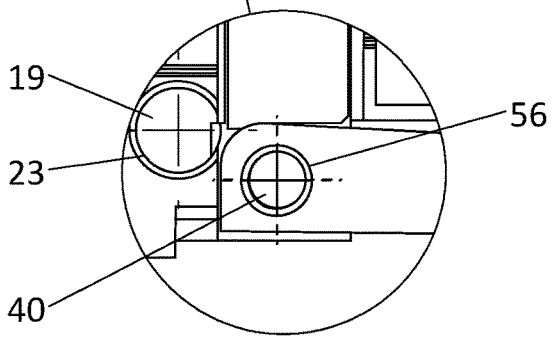
Fig. 32

SURFACE-MOUNTABLE ELECTRIC STRIKE

BACKGROUND

Strikes are generally used in conjunction with a door to selectively retain the door in a closed position. In some instances, the strike is electric, enabling the electric release of a locked mechanism. The keeper of such a strike is arranged to cooperate with a latch bolt of a door lock. The lock lever is formed as a pivotable locking bar having a flat surface that contacts against a flat surface of the keeper. When the lock lever is released, opening the door pushes the latch bolt against the keeper thereby pivoting the keeper from the door-locking to the door-releasing position. The pivoting motion of the keeper also pivots the released locking bar to its unlocking position. Two springs are provided to return the keeper and the locking bar back to their initial position, e.g., a first spring is used to return the keeper to its door-locking position and a second spring is used to return the locking bar to its locking position. The second spring forms the part of the actuation mechanism of the electric strike that pivots the locking bar to the locking position, while the keeper forms the part of the actuation mechanism that pivots the locking bar to the unlocking position when opening the door. To unlock the keeper, two electromagnets are provided that can each displace an anchor element. The anchor elements retain the locking bar in the locking position. Specifically, when both electromagnets are not energized, the anchor elements engage with the locking bar thereby preventing the locking bar, and thus the keeper, from pivoting. When the electromagnets are energized, the anchor elements are rotated by the electromagnets until they do not engage with the locking bar thereby enabling the locking bar, and thus the keeper, to pivot to release the latch bolt.

A drawback of such an electric strike is that the anchors with the electromagnets that keep the locking bar in the locking position form a complex mechanism with several relatively small moving elements. As such, this mechanism is prone to malfunctions and difficult to maintain, especially when used outdoors. Moreover, when using the electric strike for left and for right handed doors, it has to be mounted in one position onto the support for a left handed door and in an upside down position when it is used for a right handed door. This is only possible when the lock contains only one bolt, in particular a latch bolt, since otherwise the dead bolt cavity of the strike would be situated above the latch bolt cavity whilst the dead bolt of the lock would still be situated below the latch bolt.

A further drawback of conventional electric strikes is that the opening force is transmitted from the keeper to the locking bar via the flat surfaces that slide along one another. As such, there is excessive friction when opening the door, especially when the cooperating flat surfaces are not regularly lubricated or when they are covered with dirt. Moreover, when the locking bar is locked by the anchor elements, the opening force of the door is transmitted to the anchor elements, which are small when compared to the strike. As such, when a large force is exerted on the door, e.g., when a person tries to force the door open, this large force is exerted onto the small anchor elements which may be damaged due to the excessive pressures resulting in a defective strike.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one aspect the present disclosure, a surface mountable electric strike having a bolt cavity arranged to receive at least one bolt of a door lock is provided. The electric strike generally includes a strike frame; a keeper mounted on the strike frame, the keeper forming a side wall of the bolt cavity and being arranged to pivot about a first pivot axis, which first pivot axis extends in a first direction, between a door-locking position, wherein the keeper is arranged to retain the bolt to prevent door opening, and a door-releasing position, wherein the keeper is arranged to enable the bolt to exit the bolt cavity along a second direction, which second direction is substantially perpendicular to the first direction; a lock lever mounted on the strike frame for locking the keeper in the door-locking position, the lock lever being arranged to pivot about a second pivot axis between a locking position, wherein the keeper, when in the door-locking position, is prevented from pivoting around the first pivot axis to the door-releasing position by the lock lever, and an unlocking position, wherein the keeper, when in the door-locking position, is free to pivot around the first pivot axis to the door-releasing position; and at least one biasing member to urge the lock lever to one of the locking and unlocking positions.

In some embodiments, the present disclosure provides a surface mountable electric strike that has a simpler construction and that is more reliable.

In some embodiments, the second pivot axis extends substantially in the second direction, and the strike further comprises at least one electromagnet to pivot the lock lever to the other one of the locking and unlocking positions. The at least one electromagnet in some embodiments comprising a solenoid with a fixed core that is, in a third direction which is substantially perpendicular to both the first and the second direction, situated next to the lock lever, the electromagnet being oriented to produce a magnetic field that is, inside the solenoid, directed substantially in the third direction to magnetically attract the lock lever.

Due to the fact that the solenoid, which has a fixed core, is placed next to the lock lever, the electromagnet acts directly upon the lock lever. In other words, there are no intermediate moving elements between the electromagnet and the lock lever. This is thus a much simpler and reliable construction when compared to the known surface mountable electric strikes. Furthermore, this strike is also more robust when compared to the known surface mountable electric strikes as there is no need to have small, when compared to the strike, intermediate moving elements. Further, the electromagnet does not comprise a movable core so that the core of the electromagnet cannot get stuck within the solenoid.

By being pivotally mounted in the strike, the functioning of the lock lever is also more reliable since, compared to for example a sliding lock lever, a pivoting lock lever does not get easily stuck, for example when it becomes dirty or when it is not sufficiently lubricated.

Moreover, because the second pivot axis extends substantially in the second direction, the lock lever, and the core that is next thereto, can be arranged above and/or underneath the keeper thereby reducing the total depth of the strike and providing a surface mountable strike. It also enables to provide two keepers, one for cooperating with a left-handed door and one for cooperating with a right-handed door.

Some conventional electric strikes include an electromagnet acting directly upon the lock lever. In these electric strikes, the electromagnet is however placed behind the bottom of the bolt cavity. As such, the electric strike is quite voluminous, e.g., it has a large depth. Therefore, in order to mount this conventional electric strike, a part of the support needs to be cut away so that the strike can be partly mounted inside the support. As such, the conventional electric strike is not suitable as a surface mountable electric strike.

In an embodiment of the present disclosure, when the electromagnet is energized, the fixed core of the electromagnet sticks to a portion of the surface of the lock lever, whilst, when the electromagnet is not energized, a gap is present between the fixed core and the portion of the surface of the lock lever. In some embodiments, the lock lever has a free extremity with the portion of the surface of the lock lever being located between the second pivot axis and the free extremity.

As a matter of fact, the magnitude of the magnetic force increases exponentially with a decreasing distance between the magnet and the attracted surface. As such, by having the lock lever stick to the fixed core, when the electromagnet is energized, the force on the lock lever is maximized to ensure that the lock lever moves between its locking and unlocking position. An advantage of a pivoting lock lever is that, even in its unlocking position, there is only a small gap, or even no gap, at the extremity of the fixed core which is the closest to the pivot axis of the lock lever.

In an embodiment of the present disclosure, the lock lever comprises: a plate shaped portion extending, substantially along the first direction, away from the second pivot axis, the plate shaped portion having a proximal end near the second pivot axis and a distal end; a bridge element having a proximal end that is joined to the distal end of the plate shaped portion, the bridge element extending substantially along the third direction and having a distal end; and an end portion that is joined to the distal end of the bridge element and that forms the free extremity of the lock lever.

In this embodiment, the plate shaped portion of the lock lever may be placed near the back surface of the strike, e.g., close to the surface upon which the strike is to be mounted, while the free extremity may be provided near the front of the strike to engage the keeper. Because the first pivot axis of the keeper is provided near the back surface of the strike, it is beneficial if the distance between this first pivot axis and the region where the keeper engages the lock lever is as large as possible to optimally use the lever effect. This embodiment allows maximizing this distance, even if the main part of the lock lever, (e.g., the plate shaped portion), is near the back surface of the strike.

In an embodiment of the present disclosure, the second pivot axis is located in a plane that is substantially perpendicular to the first direction with the keeper and the fixed core of the electromagnet being located on the same side of the plane, the fixed core of the electromagnet being, in particular, located between the plane and a closest bounding plane of the keeper that is perpendicular to the first direction.

In an alternative embodiment of the present disclosure, the second pivot axis is located in a plane that is substantially perpendicular to the first direction and the keeper is located on one side of the plane whilst the fixed core of the electromagnet is located on the opposite side of the plane.

By changing the order of the keeper, electromagnet and pivot axis in the longitudinal direction of the strike, these alternative embodiments provide an easy way to create a fail-safe electric strike and a fail-secure electric strike.

In an embodiment of the present disclosure, the at least one biasing member urges the lock lever to the locking position and, when the electromagnet is energized, it magnetically attracts the lock lever to pivot from the locking position to the unlocking position.

In this embodiment the strike is fail-secure, e.g., when there is a power failure or the electromagnet is defected, the lock lever remains in the door-locking position thereby keeping the door locked.

In an alternative embodiment of the present disclosure, the at least one biasing member urges the lock lever to the unlocking position and, when the electromagnet is energized, the lock lever pivots from the unlocking position to the locking position.

In this alternative embodiment the strike is fail-safe, e.g., when there is a power failure or the electromagnet is defected, the lock lever remains in the door-releasing position thereby releasing the keeper and allowing the door to be opened.

In an embodiment of the present disclosure, the lock lever and the keeper each have a free extremity, the lock lever comprising a first interlocking element located at the free extremity, which first interlocking element cooperates, when the lock lever is in the locking position and the keeper in the door-locking position, with a second interlocking element on the keeper to prevent the keeper from pivoting around the first pivot axis to the door-releasing position, wherein the second interlocking element may be located at the free extremity of the keeper.

Because the interlocking elements transmit forces, for example lateral forces, between the lock lever and the keeper it is advantageous to position the interlocking elements as far away as possible from respectively the first and the second pivot axis.

In an embodiment of the present disclosure, the strike frame is provided with a bearing element arranged to bear against the lock lever to prevent the lock lever, when the lock lever is in its locking position and when the keeper is in its door-locking position, from being moved in the second direction when the bolt of the door lock is urged against the keeper.

The bearing element acts as a stop against possible lateral motions of the lock lever (e.g., motions along the second direction). Such motions may be induced by trying to force open the door lock when the lock lever is in its locking position. Such motions may also be induced by closing the door when the keeper is in the door-locking position. By providing the bearing element, it is avoided that the forces due to these lateral motions are exerted onto the second pivot axis that connects the lock lever to the strike. As such, this connection is less prone to being damaged, especially when the second pivot axis (of the lock lever) extends substantially in the second direction so that torsion forces are exerted onto the axis of the lock lever, and a more robust strike is obtained.

In an embodiment of the present disclosure, the lock lever has a free extremity, the bearing element bearing against the lock lever at the free extremity of the lock lever.

This is advantageous as the largest lateral forces are expected near the free extremity of the lock lever which are then directly transmitted to the bearing element.

In an embodiment of the present disclosure, the lock lever has a free extremity and comprises a first interlocking element located at the free extremity, which first interlocking element cooperates, when the lock lever is in the locking position and the keeper in the door-locking position, with a second interlocking element on the keeper to prevent the keeper from pivoting around the first pivot axis to the door-releasing position, wherein the bearing element may bear against the first interlocking element.

Because the interlocking elements transmit forces, for example lateral forces, between the lock lever and the keeper it is advantageous to position the bearing element at this location.

In an embodiment of the present disclosure, the strike comprises a further keeper mounted on the strike frame, the further keeper forming a further side wall of the bolt cavity, the further side wall being opposite to the side wall of the bolt cavity, the further keeper being arranged to pivot about a third pivot axis, which third pivot axis is substantially parallel to the first pivot axis, between a door-locking position, wherein the further keeper is arranged to retain the bolt to prevent door opening, and a door-releasing position, wherein the further keeper is arranged to enable the bolt to exit the bolt cavity in a direction opposite to the second direction.

In this embodiment the strike is suited for both left and right handed doors without having to mount the strike upside down. As such, the strike is easily useable for door locks comprising a latch bolt and a dead bolt.

In some embodiments, in the door-locking position of the further keeper, the further keeper is prevented by the lock lever, in the locking position thereof, from pivoting around the third pivot axis to the door-releasing position and is free to pivot around the third pivot axis to the door-releasing position in the unlocking position of the lock lever.

As such, the lock lever may be arranged to operate both keepers in the same way simultaneously.

In one embodiment of the present disclosure, the lock lever has a free extremity and comprises: a first interlocking element located at the free extremity, which first interlocking element cooperates, when the lock lever is in the locking position and the keeper in its door-locking position, with a second interlocking element on the keeper to prevent the keeper from pivoting around the first pivot axis to its door-releasing position; and a third interlocking element located at the free extremity, which third interlocking element cooperates, when the lock lever is in the locking position and the further keeper in its door-locking position, with a fourth interlocking element on the further keeper to prevent the further keeper from pivoting around the third pivot axis to its door-releasing position. In some embodiments, the bearing element is positioned between the first and the third interlocking element.

Because the interlocking elements transmit forces, for example lateral forces, between the lock lever and the keepers it is advantageous to position the bearing element between these interlocking elements.

In some embodiments, the keeper and the further keeper each have a free extremity with the second interlocking element being situated near the free extremity of the keeper and with the fourth interlocking element being situated near the free extremity of the further keeper.

In this way the distance between the pivot axis of each keeper and the point where the keepers are locked by the lock lever is maximized and the forces exerted onto the interlocking elements are minimized.

In an embodiment of the present disclosure, the strike further comprises a door stop that is mountable to the strike frame on a first side of the strike when the keeper has to co-operate with the bolt and on a second side of the strike when the further keeper has to co-operate with the bolt. In some embodiments, the strike comprises at least one spacer which is configured to be affixed between the door stop and the strike frame.

In this embodiment, the door stop is also reversible so that even with the door stop, the strike can easily be used for both left and right handed doors. Moreover, the at least one spacer may be used to correct the position of the door stop depending on the thickness of the door (gate) onto which the lock is mounted.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein:

FIGS. 31 and 32 are similar views to FIGS. 9 and 10, but for the strike of FIG. 29 with the lock lever in an unlocking position;

FIGS. 33 to 36 are similar views to FIGS. 29 to 32, but showing the alternative embodiment of the strike holding a latch bolt of a door lock in the door-locking position with the lock lever in a locking position.

DETAILED DESCRIPTION

Figure 1:
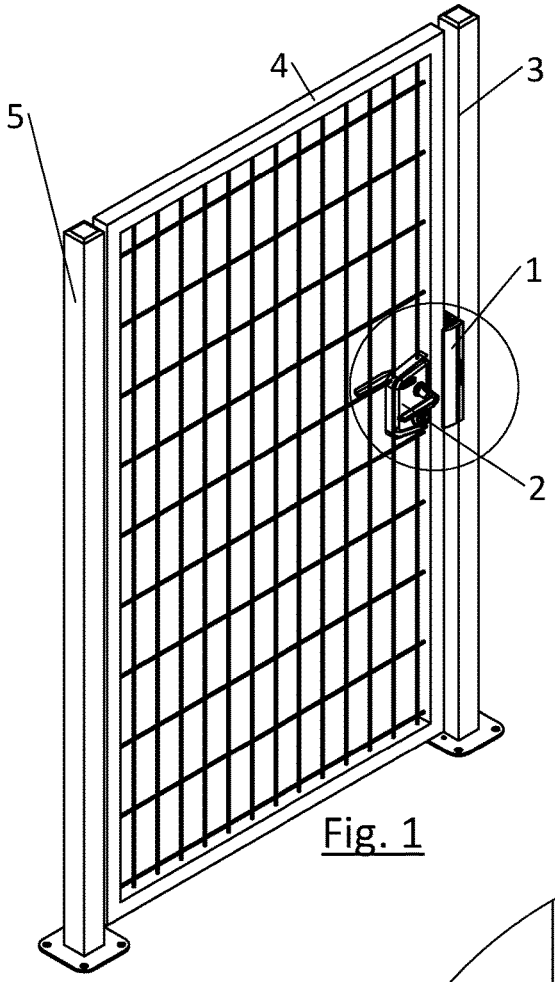
FIG. 1 shows a perspective view of one representative embodiment of a door (gate) with an electric strike in accordance with aspects of the present disclosure.
Figure 2:
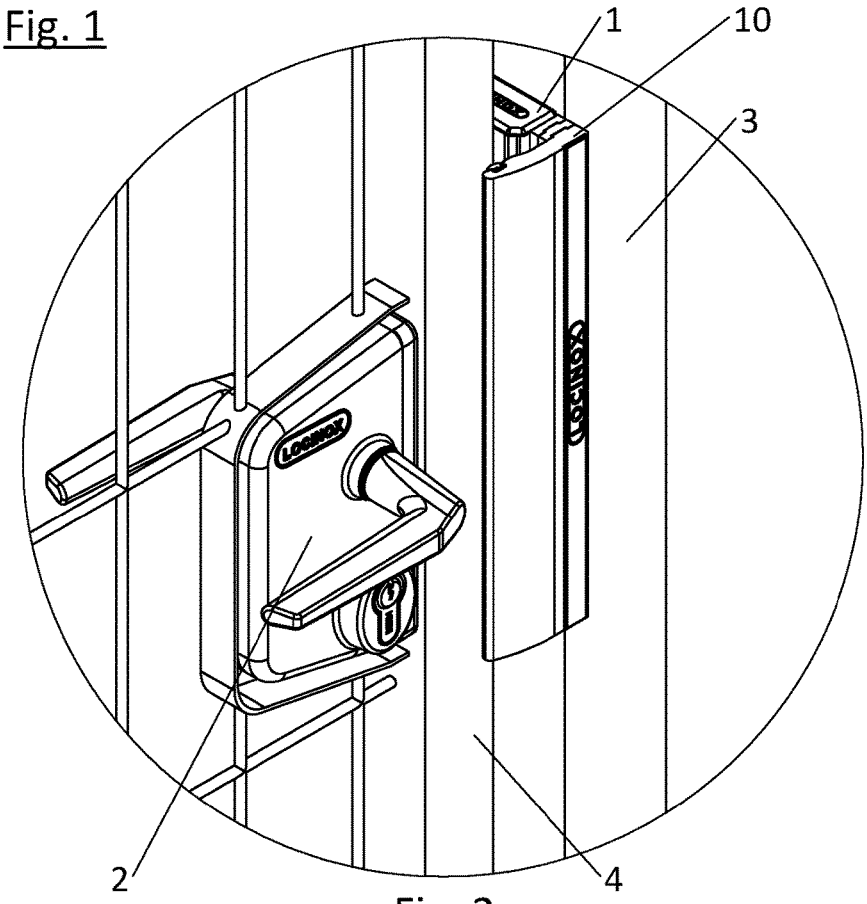
FIG. 2 shows a door lock and electric strike of FIG. 1 in more detail.

The detailed description set forth below in connection with the appended drawings are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or to limit the disclosure to the precise forms disclosed.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "rear," "upward," "downward," "top," "bottom," "right hand," "left hand," "lateral," "medial," "in," "out," "extended," etc. These references, and other similar references in the present application, are only to assist in helping describe and to understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "substantially," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

As shown in the FIGURES, the present disclosure generally relates to an electric strike 1, e.g., a strike 1 comprising a keeper which can be operated electrically. This can be done from a distance, for example from within a house when the strike 1 is mounted on a gate outside, or it can be done by means of a code system. The electric strike 1 is arranged to co-operate with a door lock 2 having a bolt, in particular a latch bolt, and, optionally, a dead bolt. The electric strike 1 therefore has at least one bolt cavity, in particular a latch bolt cavity 6, and optionally a dead bolt cavity 7. The door lock 2 has on at least one side of the door no handle or otherwise a fixed handle (as illustrated in the FIGURES) so that from that side of the door the latch bolt can only be released by unlocking the keeper of the electric strike 1. In other embodiments, if the door lock comprises a dead bolt, the latch bolt can also be opened by means of a second turn of the key that is used to unlock the dead bolt when such a second turn mechanism is provided in the door lock 2.

The electric strike 1 illustrated in the FIGURES is arranged to be mounted onto a support 3 which is, for example, part of a garden fence and which is often placed in the ground. The support 3 can however also be formed by the fixed leaf of a double gate. The door or gate 4 (called hereinafter "a door" in general) onto which the door lock 2 is mounted is hinged on a second support 5 situated opposite the support 3 as shown in FIG. 1. This second support 5 is also often placed in the ground, but may also be formed by other means, e.g., a wall of building.

Figure 3A:
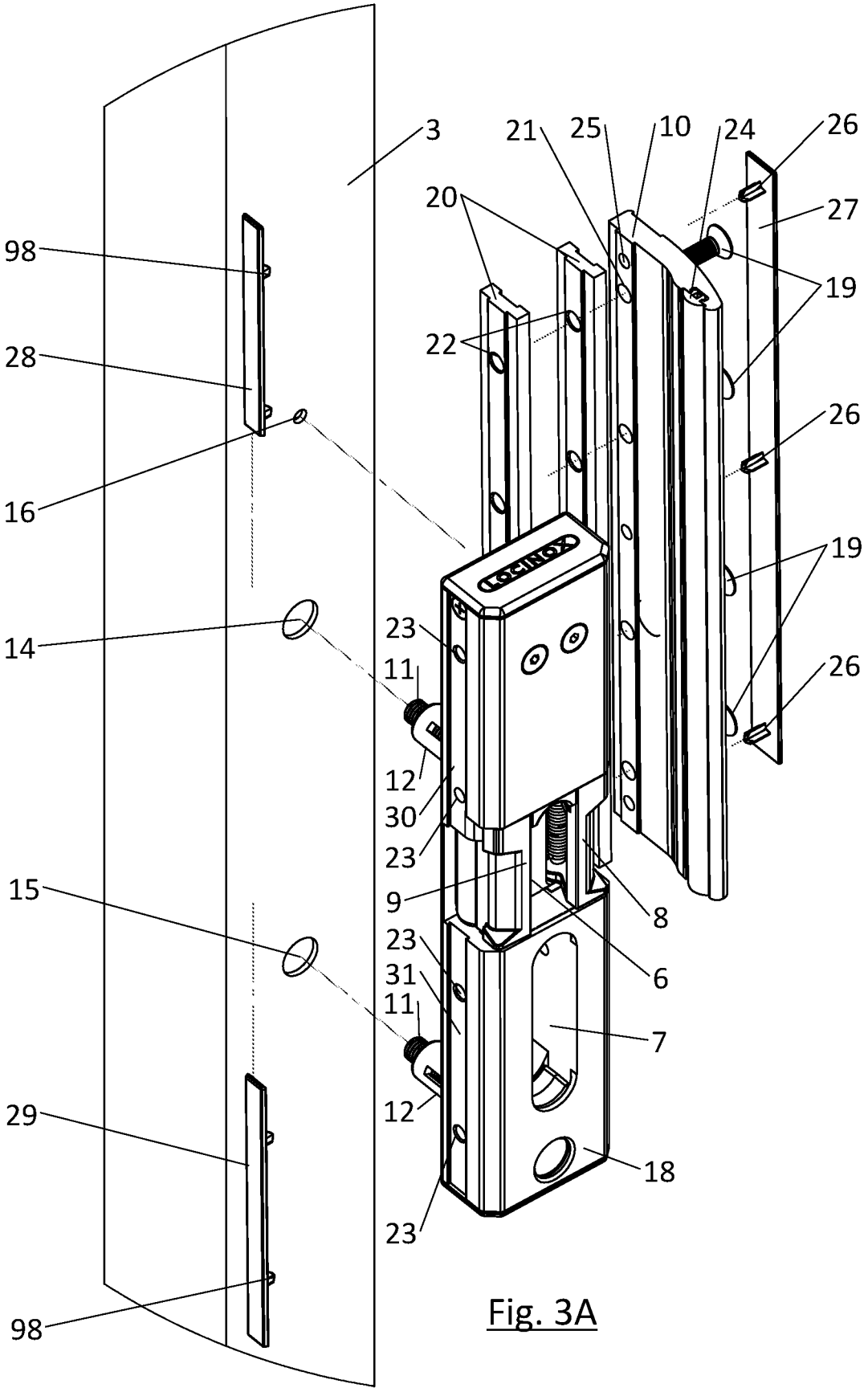
FIGS. 3A and 3B show an exploded view of the attachment of one representative embodiment of a door stop, a strike frame, and a support for both a left handed and a right handed door, in accordance with aspects of the present disclosure.
Figure 3B:
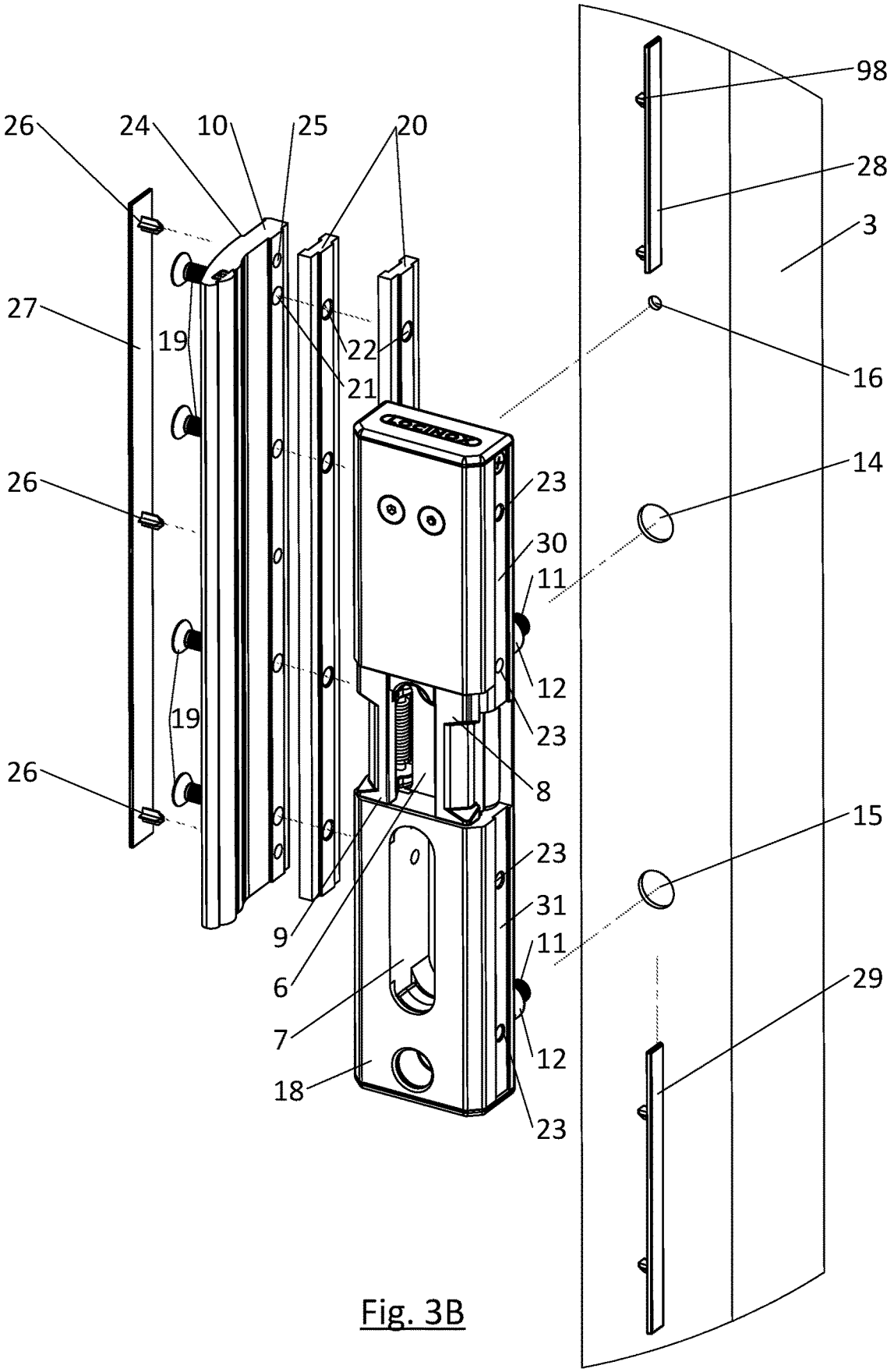

In the illustrated embodiments, the electric strike 1 can be used for left and for right handed doors 4. This is possible since both longitudinal side walls of the latch bolt cavity 6 are formed by a keeper 8, 9 and the door stop 10 can be mounted either adjacent to the first keeper 9 or adjacent to the second keeper 8, as illustrated in FIGS. 3A and 3B. As such, for a left handed door 5, the door stop 10 may be placed adjacent to the second keeper 8 with the first keeper 9 then being used to retain the latch bolt of the door lock 2 to prevent door opening, while, for a right handed door 5, the door stop 10 may be placed adjacent to the first keeper 9 with the second keeper 8 then being used to retain the latch bolt of the door lock 2 to prevent door opening. As a consequence, according to the present disclosure there is thus no need to mount the strike 1 upside down for differently oriented doors 5, nor do parts of the strike 1 need to be turned upside down as in some conventional strikes using an electromagnet.

FIGS. 3A to 4C illustrate how the strike 1 according to the present disclosure is mounted onto the support 3. In some embodiments, the strike 1 is fixed to the support 3 using fixture sets, e.g., by inserting bolts 11 through the strike frame 18 (also illustrated in FIG. 19) and through conical fixation elements 13 into nut elements 12. By tightening the bolts 11, the nut elements 12 slide over the conical fixation elements 13 and are thereby expanded. The nut elements 12 slide over the fixation elements 13 until they engage the inner surface of the tubular support 3. In the illustrated embodiments, two such fixture sets are used, each of which is partly placed inside a corresponding opening 14, 15 in the support 3. It will be readily appreciated that three or more fixture sets could also be used to fasten the strike 1 to the support 3. Moreover, the strike 1 may also be mounted to the support 3 by alternative means, such as nuts and bolts or screws. In case the support 3 is a solid support, for example a wooden poste, the strike 1 can be fixed thereto simply by means of screws or with plugs and screws.

FIGS. 3A and 3B further illustrate that a third opening 16 is provided in the support 3. This opening 16 is used to provide the strike 1 with the necessary electrical connections. For example, an electric wire of the strike 1 may be placed through this opening 16.

FIGS. 3A and 3B also illustrate how the door stop 10 is attached to the strike frame 18. Specifically, the door stop 10 is fixed to the strike frame 18 by four bolts 19 with two spacers 20 that are interposed between the strike frame 18 and the door stop 10. As shown by the dashed lines in FIGS. 3A and 3B, the bolts 19, in particular four bolts, are bolted through openings 21 in the door stop 10 and also through openings 22 in the spacers 20 into holes 23 in the strike frame 18. It will be appreciated that more or fewer bolts 19 may also be used to fix the door stop 10 and optionally the spacers 20 to the strike 1.

Figure 4C:
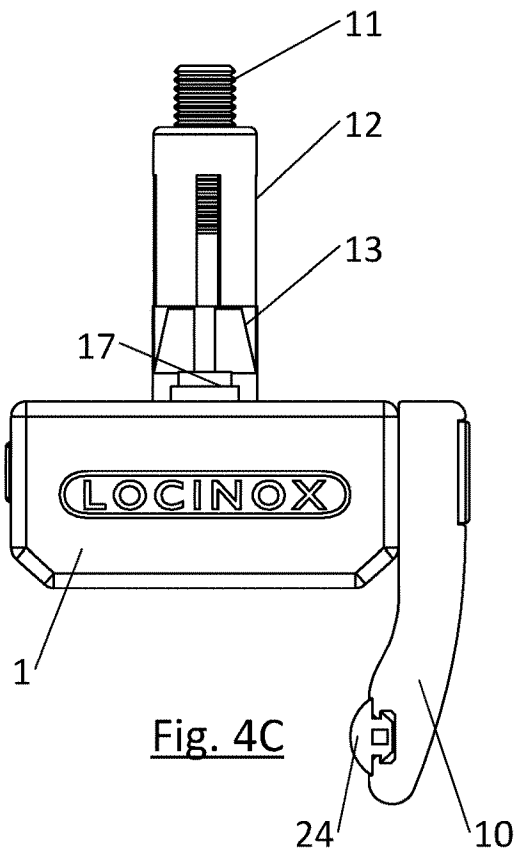
FIGS. 4B and 4C show similar views as FIG. 4A for strikes having only a single or no spacer, respectively, between the strike frame and the door stop.
Figure 4B:
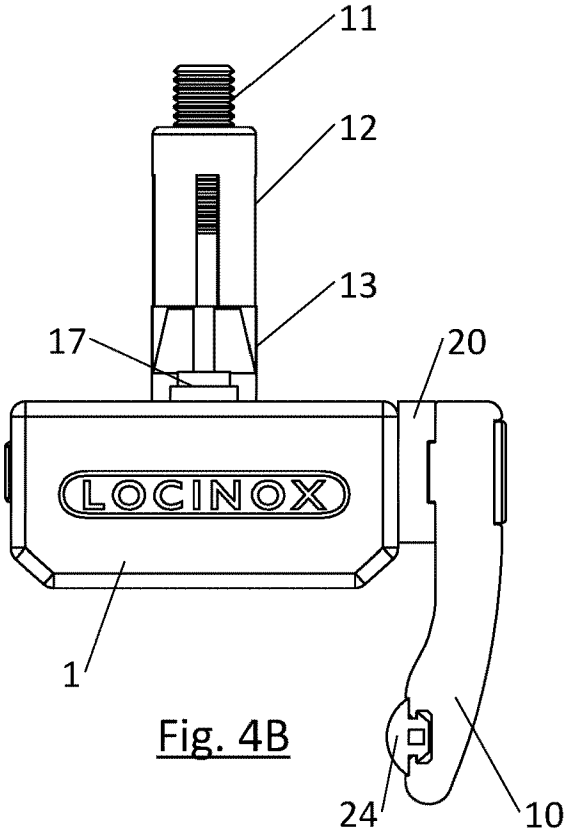
Figure 4A:
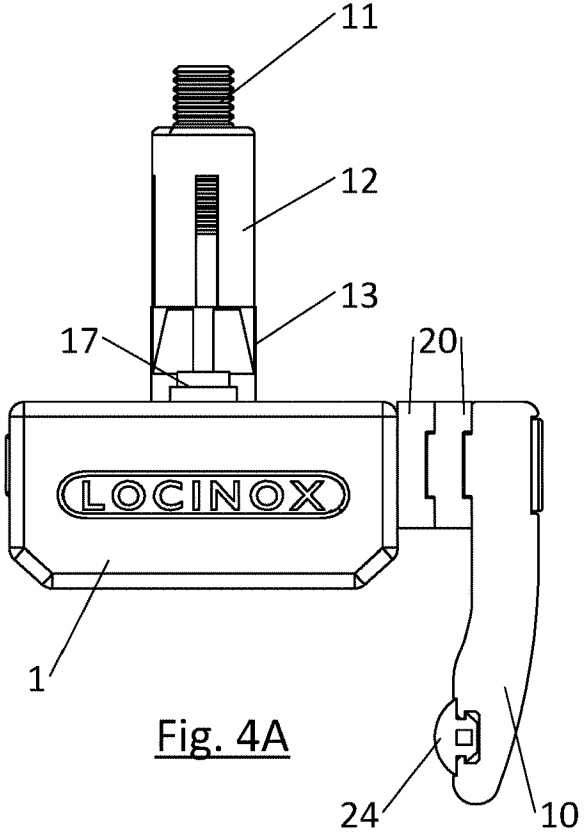
FIG. 4A shows a top view of the strike of FIG. 3A.

The spacers 20 are used to place the door stop 10 closer or further away from the strike 1. Using the spacers 20 enables to align the latch bolt and/or the dead bolt of the door lock 2 with the latch bolt cavity 6 and/or the dead bolt cavity 7. As such, more or fewer or no spacers 20 may also be used as illustrated in FIGS. 4A to 4C.

In some embodiments, both the door stop 10 and the spacers 20 are made from extruded metal, in particular, extruded aluminum. In other embodiments, the door stop 10 also has a polymer strip 24, in particular a rubber strip, to decrease the impact of the door 4 against the door stop 10 thereby avoiding and/or decreasing possible damage.

As illustrated in FIGS. 3A and 3B, the door stop 10 also has smaller openings 25, in particular three such openings 25, to receive pins 26 of a cover 27. In this way, the cover 27 may be attached by a clamp connection to the outside of the door stop 10 to hide the bolts 19 from view. Because the door stop 10 is reversible, the holes 23 used to insert the bolts 19 are also available on the opposite longitudinal side of the strike 1. As such, similar covers 28, 29 are provided to cover these regions. In particular, these covers 29, 29 fit into corresponding grooves 30, 31 in the strike frame 18 and are fixed, again by a clamp connection of pins 98, into the holes 23 of the strike frame 18.

Figure 5:
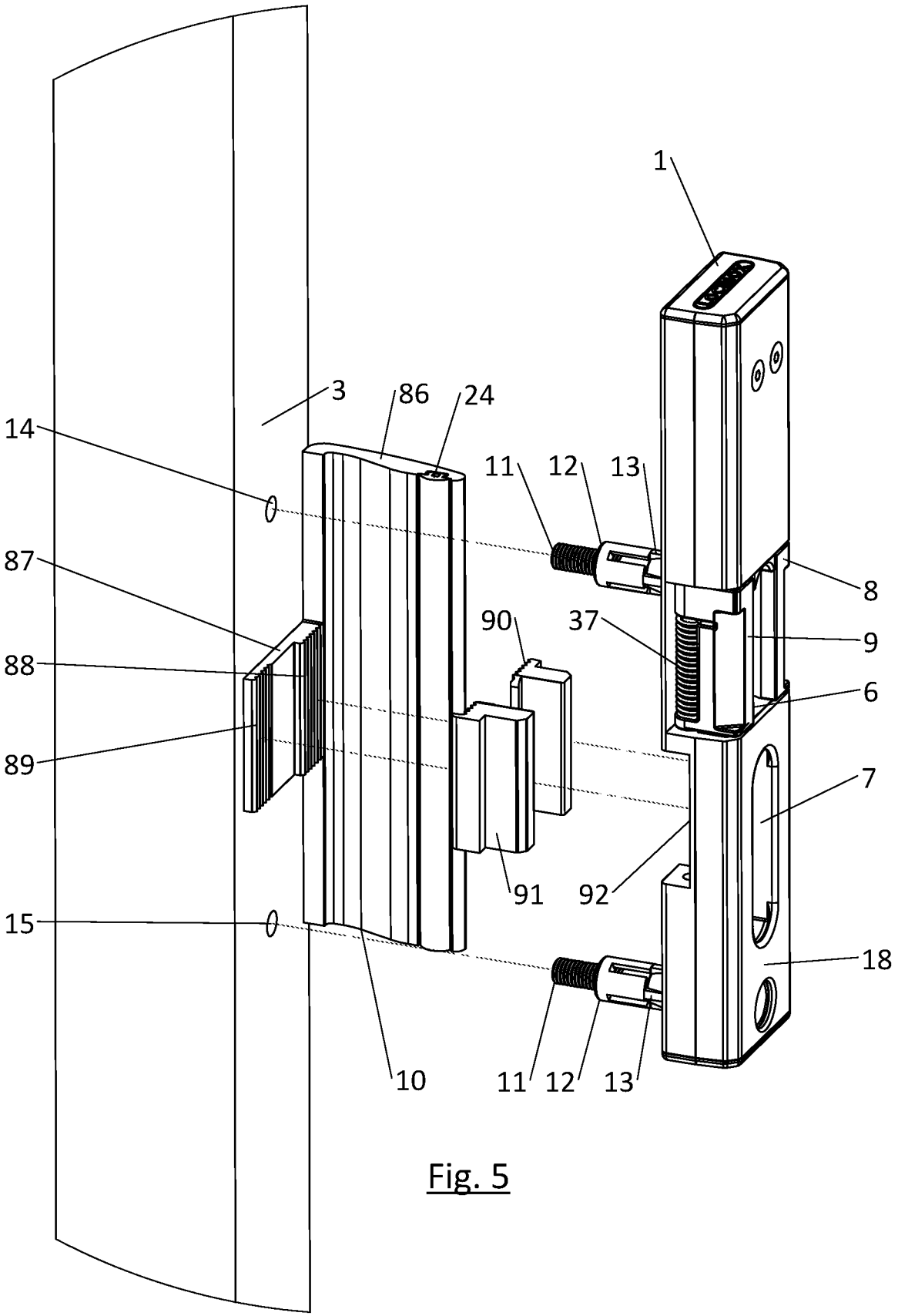
FIG. 5 shows an exploded view of one representative embodiment of an alternative reversible attachment of the door stop, the strike, and the support, in accordance with aspects of the present disclosure.

It will be appreciated that alternative constructions are possible to fix the door stop 10 relative to the strike 1. For example, FIG. 5 shows an exploded view of an alternative reversible attachment of the door stop 10, the strike 1 and the support 3. As in the previous embodiment, a strike 1, having two keepers 8, 9 defining side walls of a latch bolt cavity 6 and a dead bolt cavity 7, is attached to an support 3 using fixture sets, e.g., by inserting bolts 11 through fixation elements 12 into nut elements 13 that automatically fasten due to a square cross-section that fits into a square section of a locking plate (not shown). In particular, two such fixture sets are used, each of which is partly placed inside a corresponding opening 14, 15.

In this alternative embodiment, the door stop 10 is formed as an angular profile having a first leg 86 and a second leg 87. The first leg 86 has the same function as the door stop 10 described in FIGS. 3A to 4C, namely stopping the closing movement of the door 4 at the correct position. The first leg 86 also comprises a polymer strip 24, in particular a rubber strip, to decrease the impact of the door 4 against the door stop 10 thereby avoiding and/or decreasing possible damage. The second leg 87 of the door stop 10 is placed against the support 3 and has a first portion 89 with a plurality of longitudinal grooves and a second portion 89 with another plurality of longitudinal grooves. On each of these portions 88, 89 a connection element 90, 91 is placed that fits into a recess 92 in the strike 1. Each of the connection elements 90, 91 also has a plurality of longitudinal grooves that cooperate with the grooves on the respective portions 88, 89. Once the strike 1 is mounted to the support 3, the grooves interlock and the door stop 10 cannot shift with respect to the strike 1. Furthermore, the plurality of grooves enable to set the distance between the first leg 86 of the door stop 10 and the strike 1, thus performing the same function as the spacers 20 in the embodiment illustrated in FIGS. 3A to 4C.

Figure 6A:
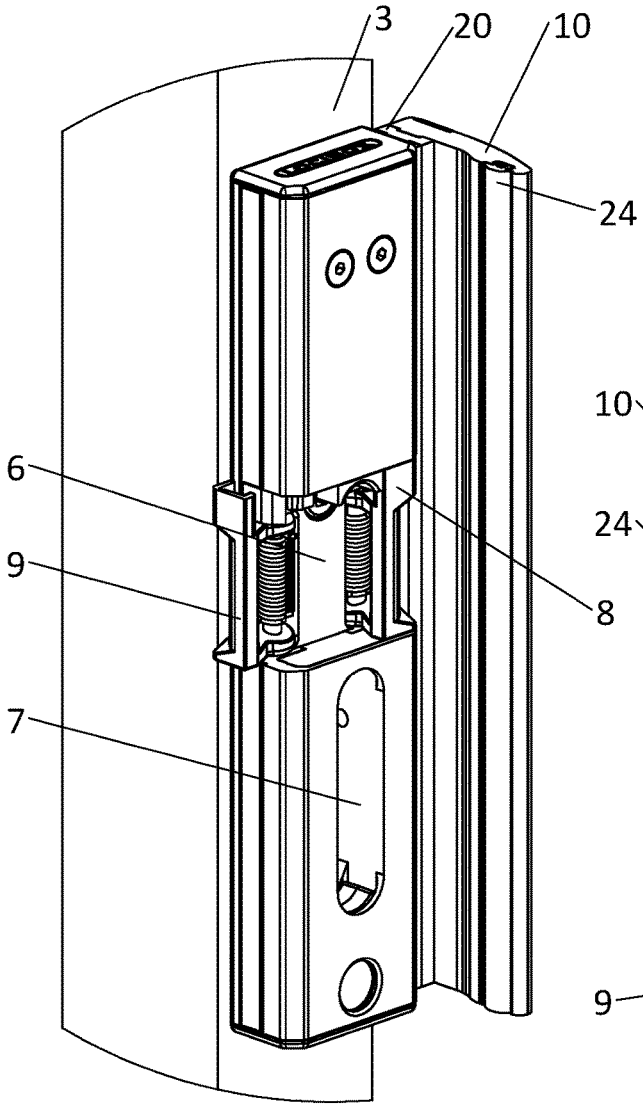
FIGS. 6A and 6B show the strike of FIGS. 3A and 3B, respectively, mounted onto the support.
Figure 6B:
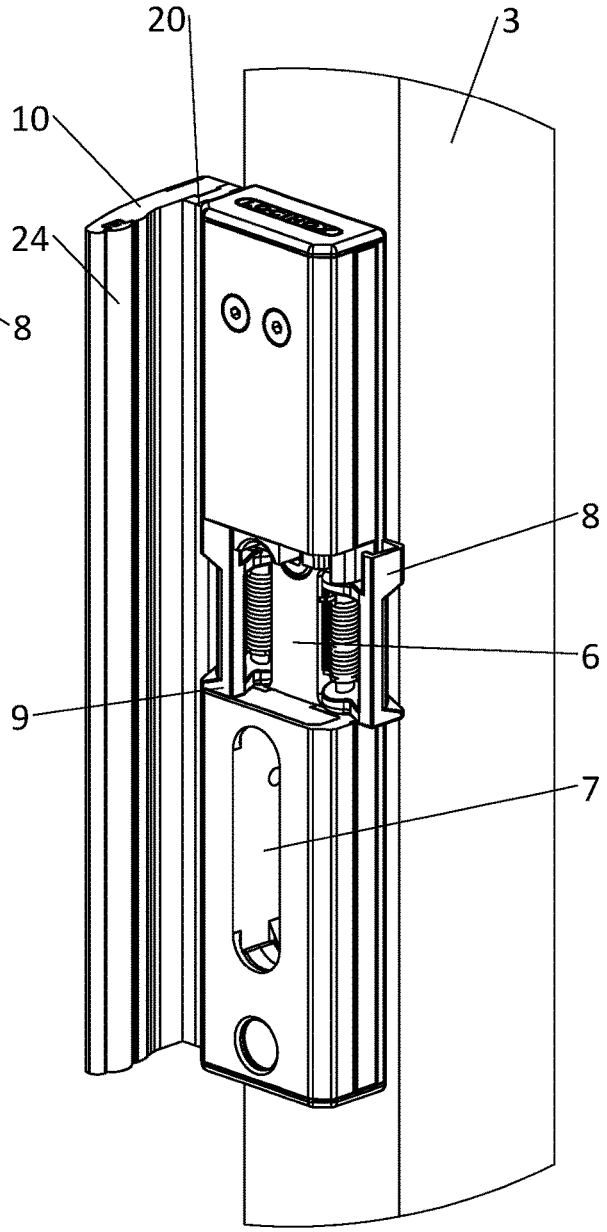

FIGS. 6A and 6B show the strike of FIGS. 3A and 3B respectively mounted onto the support 3. In FIG. 6A, the door stop 10 is placed adjacent to the second keeper 8 and the first keeper 9 is in the door-releasing position. In FIG. 6B, the door stop 10 is placed adjacent to the first keeper 9 and the second keeper 8 is in the door-releasing position.

Figure 7:
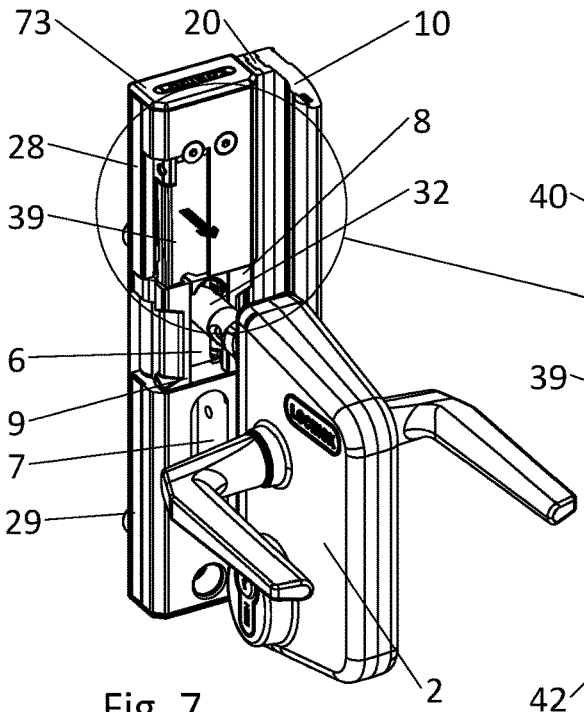
FIG. 7 shows a perspective view of the strike of FIG. 6A holding a latch bolt of a door lock in the door-locking position with a section of the front cover of the strike having been removed to see details on the lock lever and the keeper.
Figure 8:
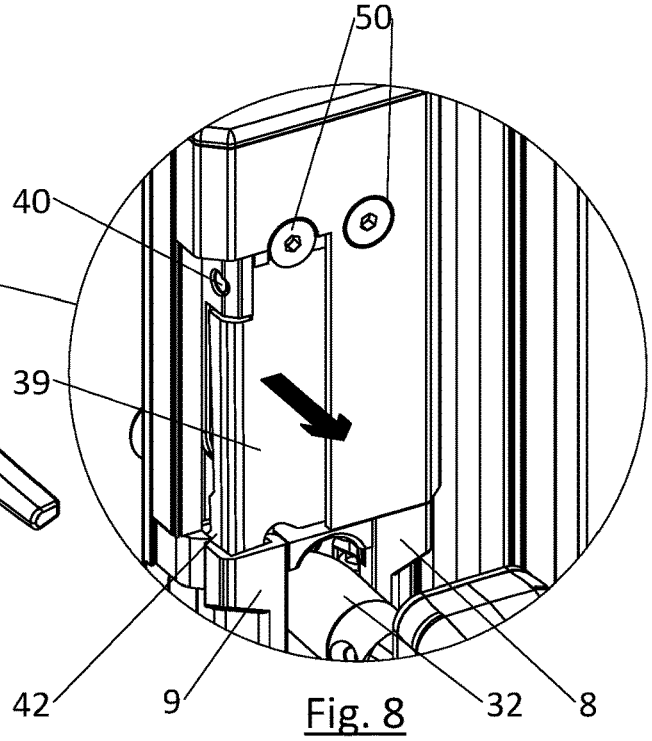
FIG. 8 shows, on a larger scale, a detail of the door lock and the strike of FIG. 7.
Figure 13:
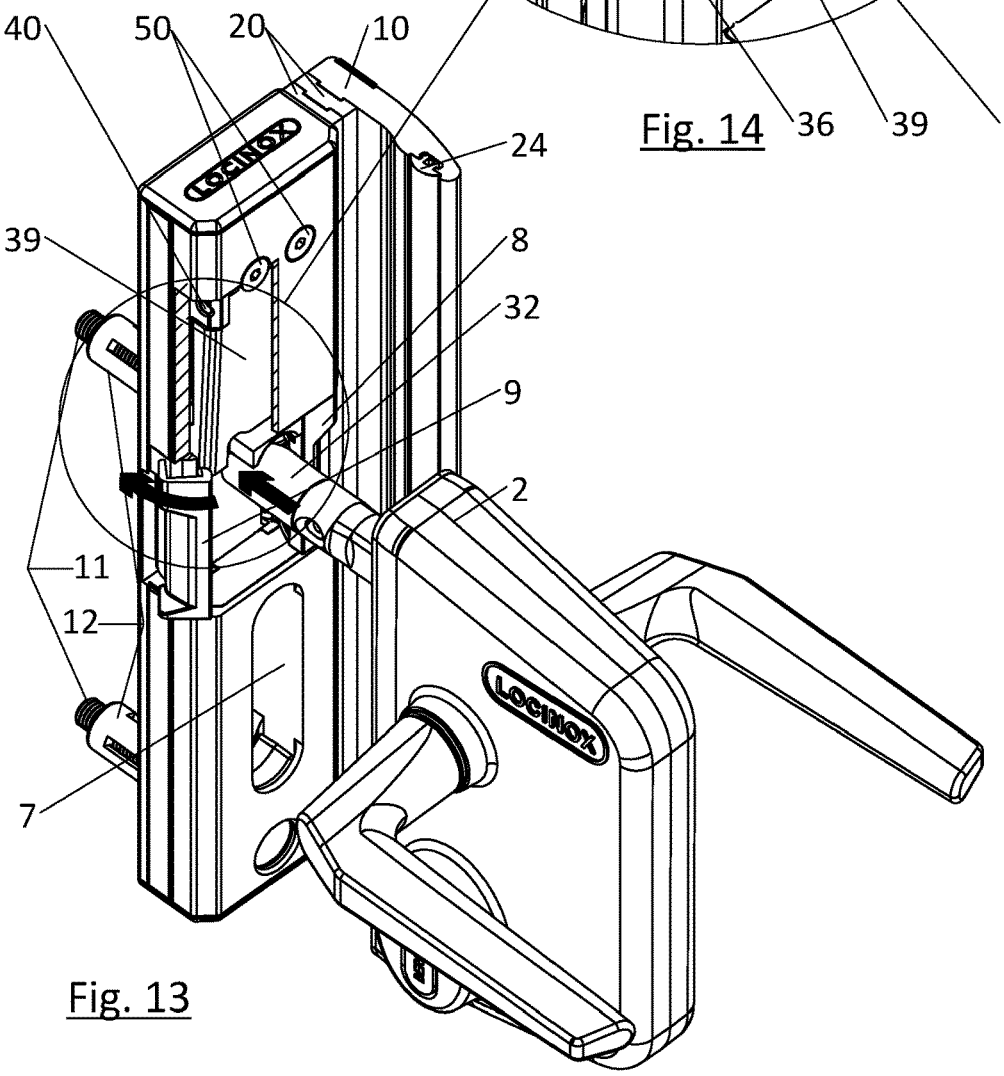
FIG. 13 is a similar view as FIG. 7 but showing the lock lever in its unlocking position and the keeper in its door-releasing position.
Figure 15:
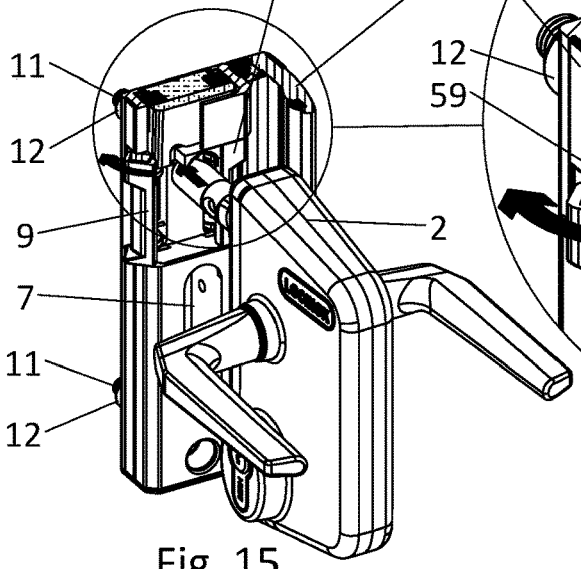
FIG. 15 shows a perspective view of the strike of FIG. 13 with a transverse cross-section through the strike.
Figure 16:
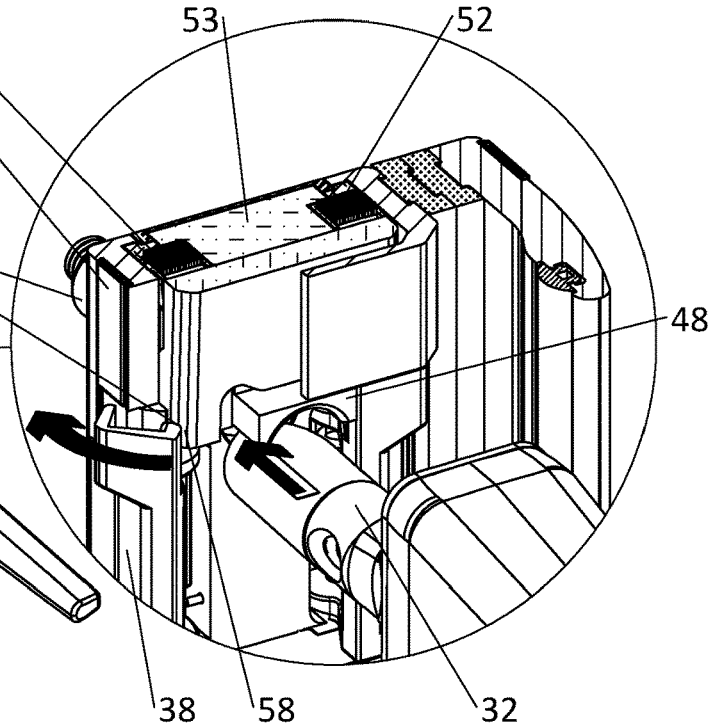
FIG. 16 shows, on a larger scale, a detail of FIG. 15.

FIGS. 7 and 13 show a perspective view of a strike 1 in combination with a door lock 2 having a latch bolt 32 that is inserted into the latch bolt cavity 6 of the strike 1 in the door-locking position and the door-releasing position respectively.

Figures 19, 20:
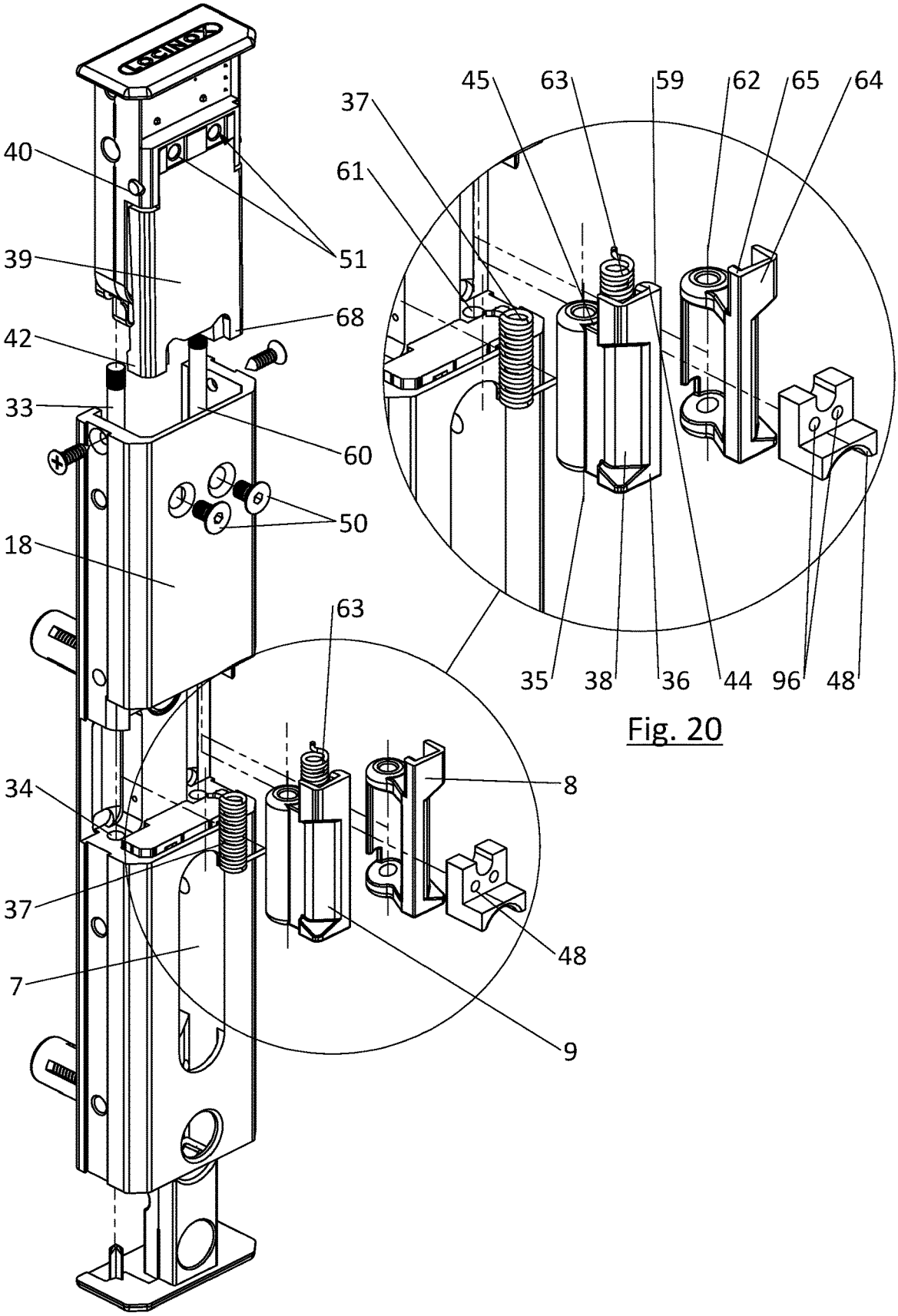
FIG. 19 shows a partly exploded view of one representative embodiment of an electric strike in accordance with aspects of the present disclosure.
FIG. 20 shows, on a larger scale, a detail of FIG. 19 in an exploded view.
Figure 21:
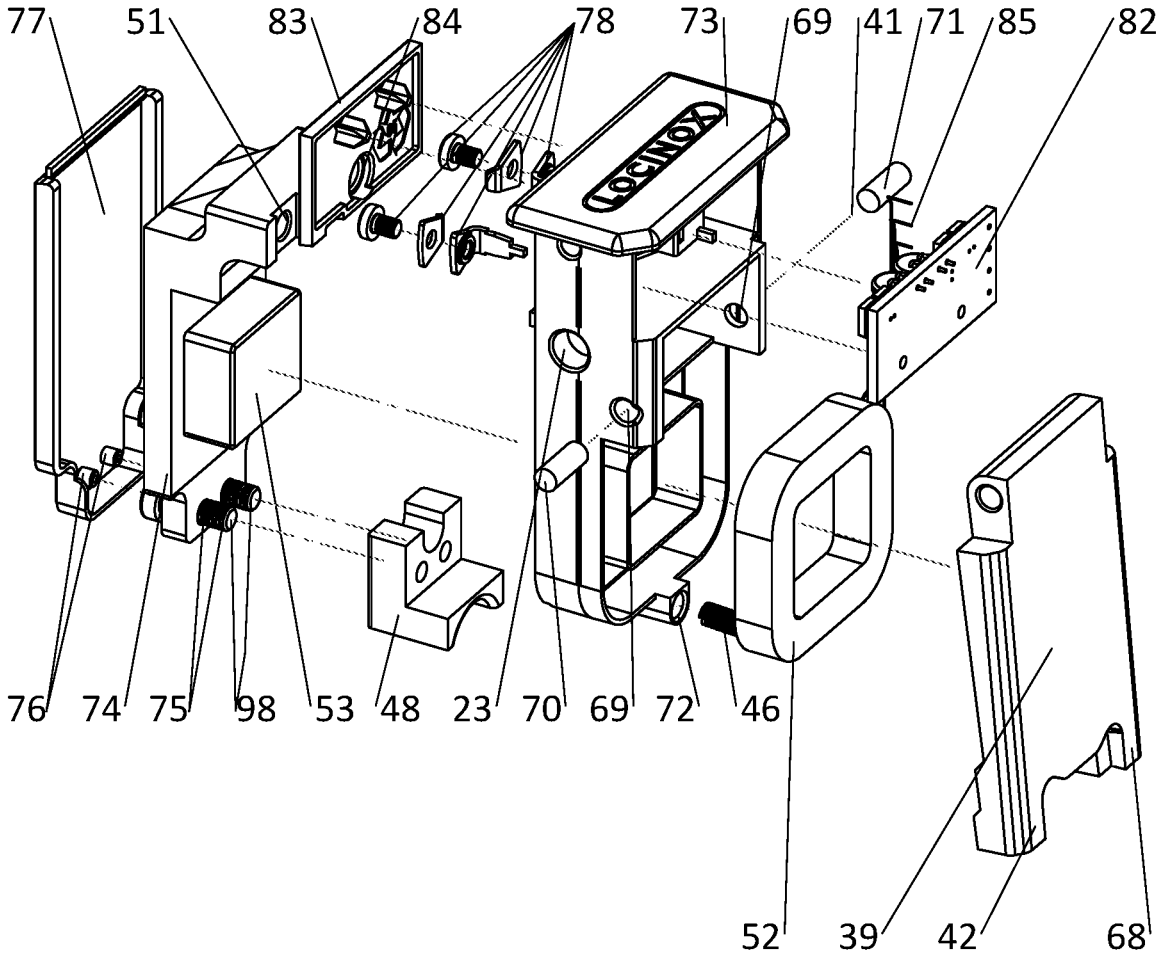
FIG. 21 shows an exploded view of the top part of the strike that was not exploded in FIG. 19.

FIGS. 19 to 21 show details of the construction of the strike 1 illustrated in FIGS. 7 and 13. By means of a first shaft 33 (referenced in FIG. 19) the first keeper 9 is mounted onto the strike frame 18, in a first pair of holes 34 (one of which is shown in FIG. 19) thereof, so that the first keeper 9 can pivot about a first pivot axis 35 which has a substantially vertical orientation when the strike 1 is mounted onto a vertical support 3. The keeper 9 has a projecting portion 36 which forms a longitudinal side wall of the latch bolt cavity 6. The keeper 9 can pivot about the first pivot axis 35 between a door-locking position (as illustrated in FIG. 7), wherein the projecting portion 36 of the keeper 9 withholds the latch bolt 32, and a door-releasing position (as illustrated in FIG. 13), wherein the projecting portion 36 releases the latch bolt 32 to allow door opening. A torsion spring 37 is applied over the first shaft 33, one of the extremities of the torsion spring 37 engaging the strike frame 18 and the other extremity the keeper 9 to urge the keeper 9 towards its door-locking position. When exerting a door opening force onto the closed door, this force is transmitted by the latch bolt 32 onto the projecting portion 36 of the keeper 9 so that the keeper 9 can be pivoted, as illustrated in FIG. 13, against the pressure exerted thereon in a first rotational direction by the torsion spring 37 to its door-releasing position. The projecting portion 36 of the keeper 9 has an inclined surface 38 which is situated opposite to the bolt cavity and which is arranged to co-operate with the latch bolt 32 to enable closing the door without retracting the latch bolt 32 by means of the operative handle.

In order to be able to lock the keeper 9 in its door-locking position, the electric strike 1 further comprises a lock lever 39 which is mounted by means of a second shaft 40 on the strike frame 18 so that it can pivot about a second pivot axis 41 (shown in FIG. 21), which is substantially parallel to the backside of the electric strike 1 and substantially horizontal in the vertically mounted state of the electric strike 1. An exploded view of the top part of the strike 1 is shown in FIG. 21. This view shows that the second shaft 40 consists of two shaft portions 70, 71, each of which is inserted in a hole of a further pair of holes 69 provided in a support element 73 that is located in the top part of the strike 1. By rotation about the second shaft 40, the lock lever 39 can pivot between a locking position wherein, as illustrated in FIG. 7, the keeper 9 is locked by means of the lock lever and an unlocking position wherein, as illustrated in FIG. 13, the keeper 9 is unlocked.

Figure 11:
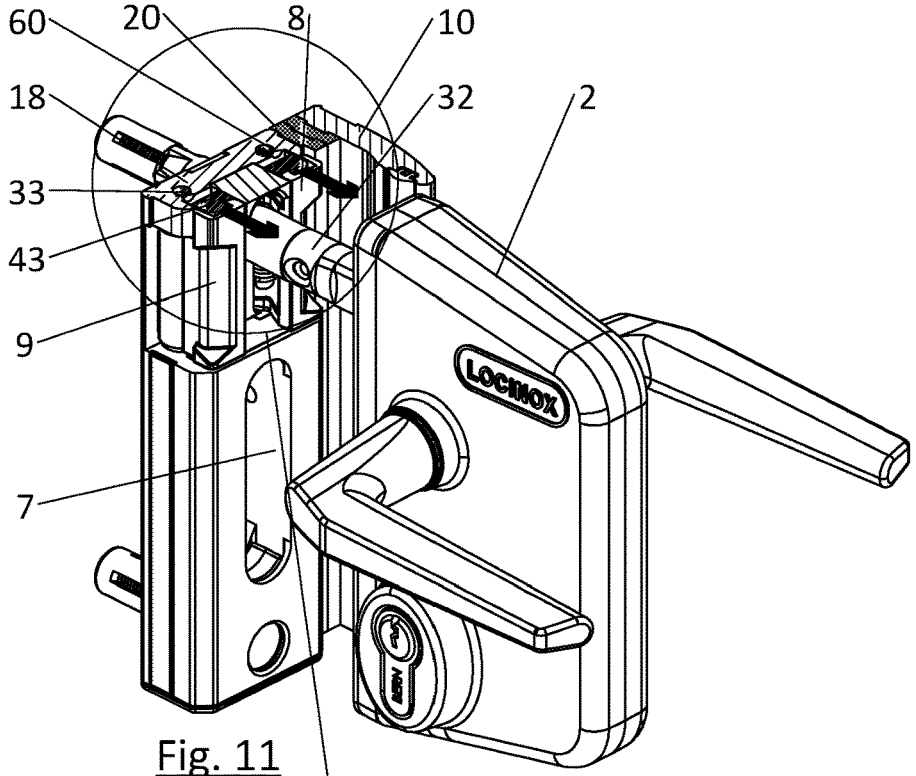
FIG. 11 shows a perspective view with a transverse cross-section through the strike of FIG. 7.
Figure 12:
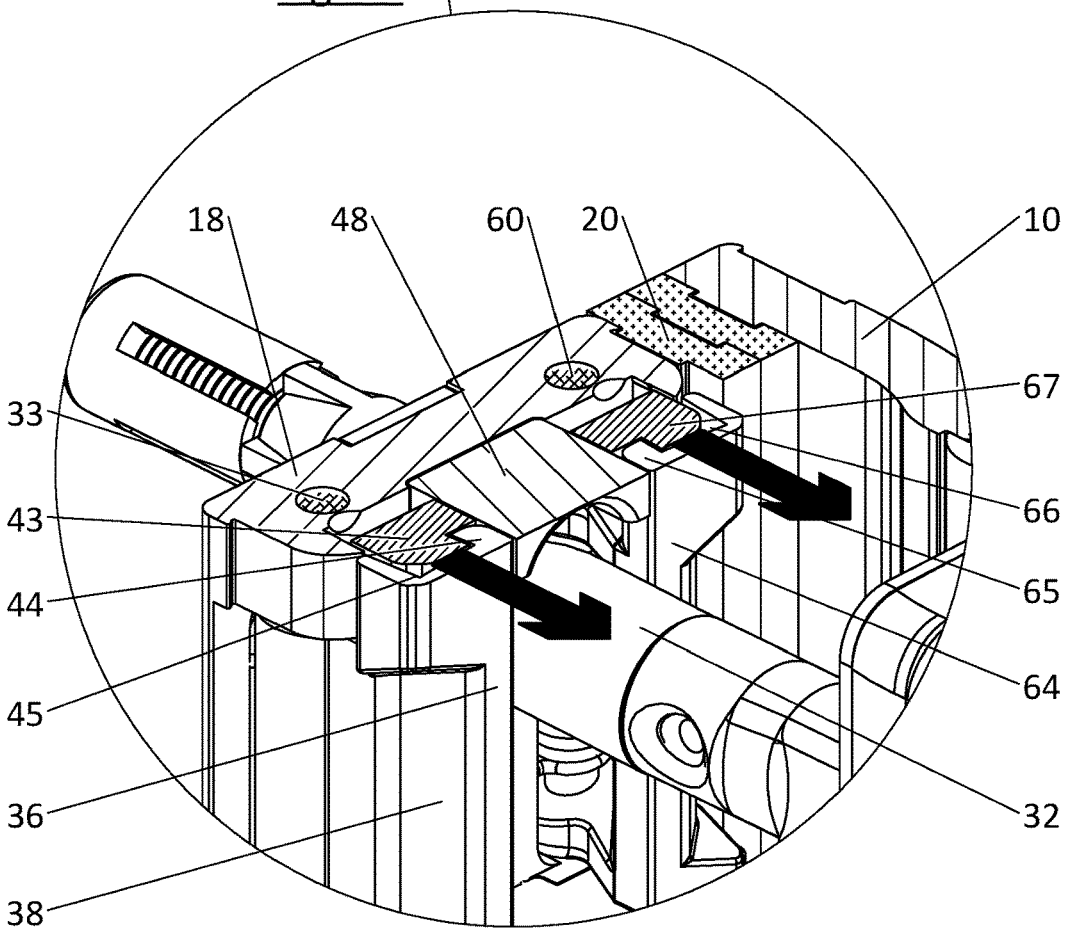
FIG. 12 shows, on a larger scale, the cross-section of FIG. 11.

The cooperation between the lock lever 39 and the keeper 9 will be described with respect to the cross-sectional view of FIGS. 11 and 12. The lock lever 39 comprises a protrusion 42 that projects from the free extremity of the lock lever 39 on the opposite side of the pivot axis 41. The protrusion 42 has a hook-shaped interlocking element 43 arranged to hook behind an interlocking element 44 on the keeper 9, in particular on the projection portion 36 thereof, to prevent rotation of the keeper 9 from its door-locking to its door-releasing position. The interlocking element 44 on the keeper 9 is formed by a hook-shaped portion at the free edge of the projection portion 36 that forms a recess 45 in the back of the projection portion 36 in which the hook-shaped interlocking element 43 of the lock lever 39 fits. In some embodiments, the interlocking element 43 suitably engages the keeper 9 substantially at the top or at the bottom of the keeper 9.

Upon rotation of the lock lever 39 to its unlocking position, illustrated in FIGS. 13 to 18 by the straight black arrows, the interlocking element 43 disengages the interlocking element 44 and thereby releases the keeper 9 so that it can rotate towards its door-unlocking position as illustrated by the curved black arrows in FIGS. 13 to 16.

The electric strike 1 comprises an actuator for actuating the lock lever 39, e.g., for displacing the lock lever 39 between its locking and unlocking positions. This actuator comprises a helical compression spring 46 (shown in FIG. 9) which urges the lock lever 39 towards the front of the strike 1 as illustrated by the black arrows in FIGS. 7 to 12. The spring 46 is arranged with one extremity in a recess 47 in the back of the lock lever 39 and engages with its other extremity a hole 72 in a support element 73 (illustrated in FIG. 21) which is part of the strike frame 18. The actuator further comprises an electromagnet 49 (shown in cross-section in FIGS. 15 and 16) which is arranged on the strike frame 18 by two bolts 50 that are arranged to fit into two holes 51 in the top of the electromagnet 49 as illustrated in FIGS. 19 and 21. The electromagnet 49 exerts, when energized, a force onto the lock lever 39 to move the lock lever 39 against the action of the helical compression spring 46 towards its unlocking position as illustrated by the black straight arrows in FIGS. 13 to 17. In other words, the illustrated embodiment of the strike is fail-secure, e.g., when the electromagnet 49 is not energized, the keeper remains in the locking position.

Figure 9:
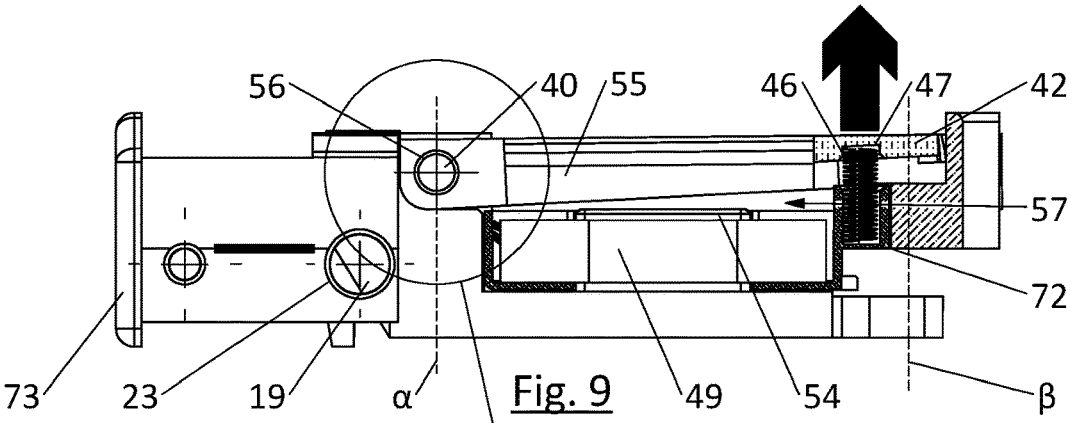
FIG. 9 shows a side view of the detail illustrated in FIG. 7.
Figure 10:
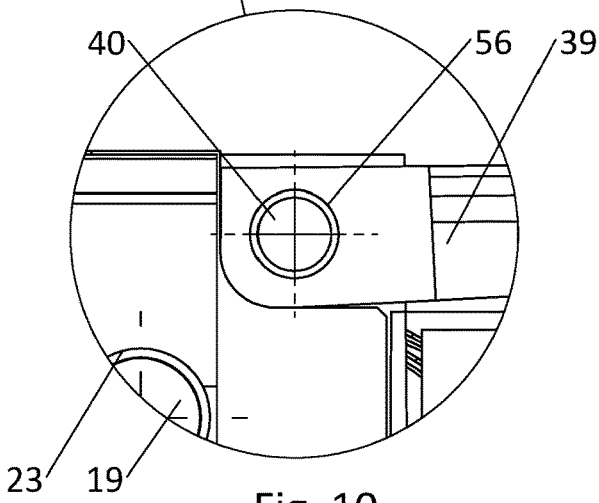
FIG. 10 shows, on still a larger scale, a detail of the lock lever near a second pivot axis of FIG. 9.
Figure 17:
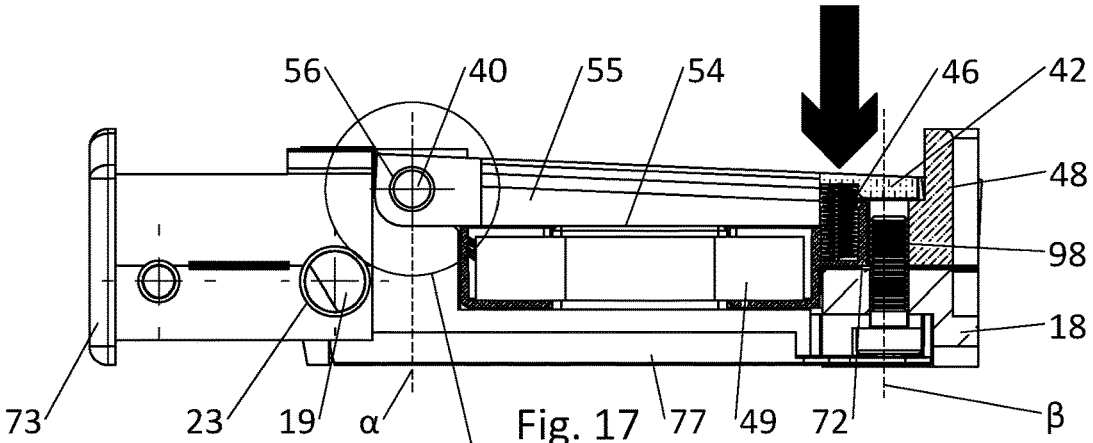
FIGS. 17 and 18 are similar views to FIGS. 9 and 10, but for the strike of FIG. 13 with the lock lever in its unlocking position.
Figure 18:
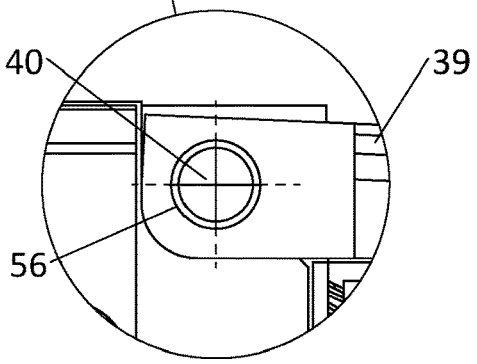

The electromagnet 49 comprises a solenoid (a coil) 52 (shown in FIGS. 15, 16 and 21) which is applied around a fixed core 53. As used herein, the term "fixed core" is intended to mean the part of the electromagnet 49 around which the coil 52 is applied. The core 53 has a surface 54 (indicated in FIGS. 9 and 17) which is directed towards the lock lever 39 and the lock lever 39 has a plate-shaped portion 55 (indicated in FIGS. 9 and 17) which is situated between the second pivot axis 41 and the hook-shaped interlocking element 43 and which is directly attracted by the electromagnet 49. In particular, as illustrated in FIGS. 9 and 17, the second shaft 40 defines a plane $\alpha$ that is perpendicular to the first pivot axis 35, e.g., perpendicular to the longitudinal direction of the strike 1. Both the keeper 9 and the core 53 are located at the same side of this plane $\alpha$. Furthermore, the keeper 9 defines a plane (3 (through which a cross-section is shown in FIGS. 11 and 12) that is also perpendicular to the first pivot axis 35, and thus parallel to the plane $\alpha$. This plane $\beta$ forms a bounding plane of the keeper that is closest to the plane $\alpha$. In some embodiments, the core 53 is located between the planes $\alpha$ and $\beta$.

The electromagnet 49 extends in the longitudinal direction, e.g., in the direction of the first pivot axis 35, alongside the lock lever 39. As such, the coil 52 of the electromagnet is substantially located above the keeper 9. Therefore, the total depth of the strike 1, the door stop 10 not included, can be kept sufficiently small, e.g., below 3 cm and, in some embodiments, below 2.5 cm, enabling the strike 1 to be surface mountable.

It will be appreciated that the electromagnet 49 may have a larger height than the lock lever 39 and may therefore project above the lock lever 39.

It will be readily appreciated that the electromagnet 49 may also be provided with a moveable core, instead of fixed core 53. In such an embodiment, the lock lever 39 is mechanically fixed to the moveable core that is located within the solenoid. When the electromagnet is energized, the moveable core will be displaced which in turn also pivots the lock lever 39.

FIG. 21 shows an exploded view of the electromagnet 49. The coil 52 is placed in a support element 73 that matches the shape of the slab 74 of which the core 53 forms a part. In some embodiments, the slab 74 may comprise ferromagnetic material, in particular iron. The slab 74 is provided with several openings. In particular, two openings 75 to receive two bolts 98 used to a bearing element 48 (as described in more detail below) and two openings 51 (one of which is shown) to receive the bolts 50. Furthermore, the bolts 98 have a head that has a hole (not shown) to receive a pin 76 to attach a covering element 77 that forms part of the back side of the strike 1. There is also provided control circuitry 82 that is fixed to the support element 73 by fixation elements 78, to control the electromagnet 49 and an element 83 forming a second part of the back cover of the strike 1. This element 83 has an opening 84 through which the electrical wiring 85 of the electromagnet 49 may be placed. The covering element 77 and the element 83 form the back cover of the top part of the strike 1 and protect the internal elements, e.g., the control circuitry 82, the slab 74, etc., against dirt and moisture, such as mud, sand, etc.

It will be readily appreciated that the covering element 77 may also be omitted, in which case the electromagnet 49 itself forms a part of the backside of the strike 1. The advantage thereof is that it limits the total depth of the strike 1.

As illustrated in FIGS. 9 and 17, the second shaft 40 that defines the second pivot axis 41 is not in line with the surface 54 of the core 53. As such, in order to enable the plate-shaped portion 55 to stick substantially entirely to the surface 54 of the core 53, the plate-shaped portion 55 is sloped, e.g., the proximal end is thicker than the distal end. In the locking position of the lock lever 39, which is illustrated in FIG. 9, the lock lever 39 has been pushed away by the spring 37 from the electromagnet 49 towards the front of the strike 1 so that a gap 57 is formed between the surface 54 of the electromagnet 49 and the portion 5 of the lock lever 39 which is attracted by the electromagnet 49 (when energized). The presence of this gap 57 reduces the magnetic attraction forces which can be exerted by the electromagnet 49 onto the lock lever 39. When the electromagnet 49 is energized, the lock lever 39 is attracted and moves against the force of the compression spring 46 towards the electromagnet 49 (see the black arrow on FIG. 17). The pivoting motion in combination with the sloped shape of the plate 55 ensures that the plate-shaped portion 55 will contact substantially the entire surface 54 of the core 53. In this way, the lock lever 39 is strongly attracted by the electromagnet 49 in its unlocking position. An electromagnet 49 with a movable core can thus be avoided.

The operation of the electric strike 1 appears clearly from FIGS. 7 to 18. In FIG. 7, the keeper 9 is in its door-locking position and is locked therein by the lock lever 39 which is pushed by the compression spring 46 as indicated by the black arrow and shown in detail in FIG. 9. Specifically, the keeper 9 is locked by the lock lever 39 via the interlocking elements 43, 44 as clearly illustrated in FIG. 12 with the black arrow again indicating the direction the lock lever 39 is pushed by the compression spring 36.

Figure 14:
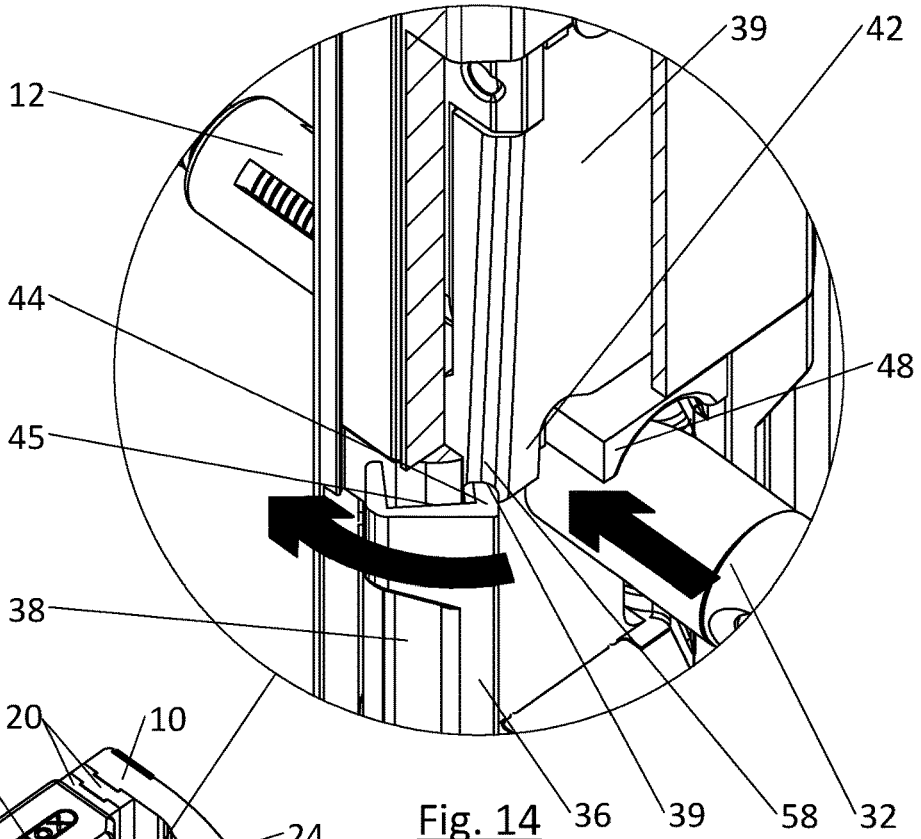
FIG. 14 shows, on a larger scale, a detail of FIG. 13.

To release the latch bolt 32 which is caught in the latch bolt cavity 6, the electromagnet 49 is energized so that it attracts the lock lever 39 and forces it into its unlocking position by rotation about its pivot axis 41. This position is illustrated in FIGS. 13 and 14. In this position, the keeper 9 is no longer locked and can be pivoted against the force of the torsion spring 37 about its pivot axis 35 towards its door-releasing position.

Typically, when opening the door, the keeper 9 is first returned by the torsion spring 37 towards its door-locking position before the electromagnet 49 is de-energized so that the lock lever 39 returns under the action of the compressing spring 46 towards its locking position (illustrated in FIG. 7). In order to enable the torsion spring 37 to still return the keeper 9 to its door-locking position in case the electromagnet 49 would be de-energized before the keeper 9 has returned to its door-locking position, the lock lever 39, in particular the protrusion 42 thereof, is provided with a first cam element 58 and the keeper 9 with a second cam element 59 (illustrated in FIGS. 14 and 16) which cooperates with the first cam element 58 to move the lock lever 39 to its unlocking position upon return of the keeper 9 to its door-locking position.

In one embodiment, the presence of the cam elements 58 and 59 on the lock lever 39 and on the keeper 9 allows the omission of a mechanism for keeping the lock lever in its unlocking position until the keeper 9 has returned to its door-locking position. In this way, a more reliable construction is obtained and more room is available in the electric strike 1 for the electromagnet 49 so that either a stronger electromagnet can be provided or so that the dimensions of the electric strike 1 can be reduced.

As described above, in some embodiments, the strike 1 may comprise two keepers 8, 9. It will be appreciated that the second keeper 8 is constructed similar to the first keeper 9 and operates in an identical fashion. Specifically, the second keeper 8 is mounted to the strike frame 18 by a third shaft 60 (indicated in FIG. 19) in a second pair of holes 61 (one of which is shown in FIG. 20) thereof, so that the second keeper 8 can pivot about a third pivot axis 62 which has a substantially vertical orientation when the strike 1 is mounted onto the support 3. Moreover, the second keeper 8 is urged to its door-locking position by a second torsion spring 63 and has a projecting portion 64 with an interlocking element 65 formed by a hook-shaped element at the free edge of the projection portion 64 that forms a recess 66 in the back of the projection portion 64 in which a hook-shaped interlocking element 67 on a protrusion 68 of the lock lever 39 fits as illustrated in FIGS. 11 and 12. As such, when the electromagnet 49 is energized, the lock lever 39 is moved closer to the backside of the strike 1 by pivoting around the second pivot axis 41 and the interlocking element 67 is also displaced to allow the keeper 8 to rotate about the third pivot axis 62 to release the latch bolt 32 from the latch bolt cavity 6. By such a design both keepers 8, 9 are operated by the same lock lever 39 which provides a simple design with a minimum of moving elements.

Figure 22:
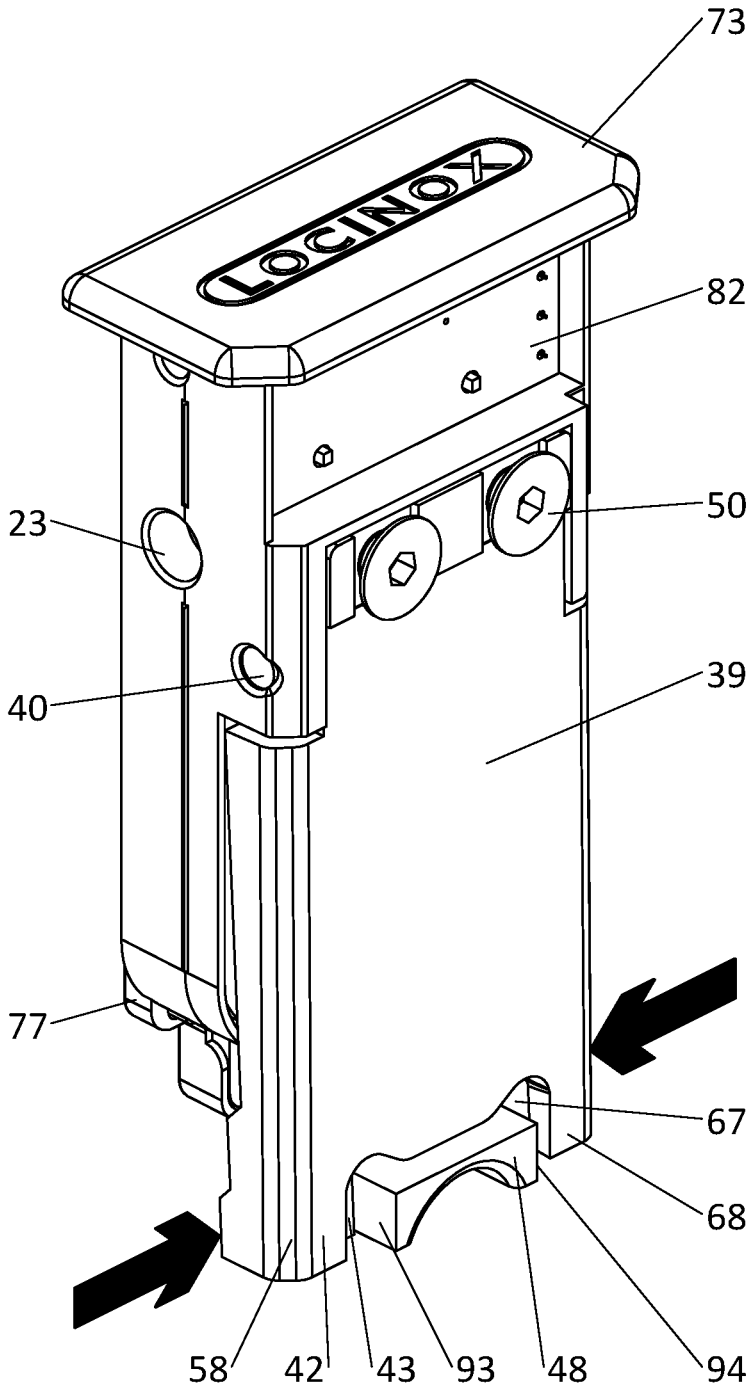
FIG. 22 shows a perspective view of the top part of the strike of FIG. 19.

FIG. 22 shows a perspective view of the top part of the strike 1. From this FIGURE, it is clear that a bearing element 48 is provided that has a first side surface 93 and a second side surface 94. The bearing element 48 is situated between the two protrusions 42, 68 of the lock lever 39, in particular with the hook-shaped interlocking elements 43, 67 adjacent to said side surfaces 93, 94. As illustrated in FIGS. 17 and 21, the bearing element 48 is fixed to the slab 74 and the strike frame 18 by two bolts 95 that are placed through openings 75 in the slab 74 and through openings in the strike frame 18 (as clearly illustrated in FIG. 17) and are screwed into corresponding openings 96 (shown in FIG. 20) in the bearing element 48. In this way, the bearing element 48 is securely fixed to the strike frame 18.

When the strike 1 holds the latch bolt 32 of the door lock 2 and the keeper 9 is held in its door-locking position by the lock lever 39, a person may, either accidentally or on purpose, try to open the door. Under such circumstances, the bolt 32 will exert a lateral force onto the keeper 9 thereby attempting to pivot the keeper 8, 9 arounds its pivot axis 35. As illustrated in FIG. 12, this pivoting motion is not possible because the interlocking element 44 of the keeper 9 interlocks with the hook-shaped element 43 on the lock lever 39. As such, the lateral force exerted onto the keeper 8, 9 will be transferred to the protrusion 42, 67 of the lock lever 39. As illustrated in FIG. 22, when this protrusion 42, 67 is subjected to a lateral force, it will abut against the first or the second side surface 93, 94 of the bearing element 48, which is solidly fixed to the strike frame 18, thereby ensuring that the lock lever 39 cannot move substantially in the lateral direction. Alternatively, when this bearing element 48 would not be present, a lateral force on the protrusion 42, 67 would be entirely exerted onto the second shaft 40 formed by the shaft portions 70, 71. The bearing element 48 thus avoids too large forces being exerted onto the second shaft 40 by acting as a stop against possible lateral motions, induced by trying to open the door lock when the lock lever 39 is in its locking position, of the lock lever 39. Advantageously, as also illustrated in the FIGURES, this bearing element 48 is located at the free extremity of the lock lever 39.

It will be appreciated that this bearing element 48 also deals with lateral forces when closing the door. Because, when closing the door, the keeper 8, 9 is normally already in the door-locking position and the lock lever 39 is also in the locking position. As described above, the inclined surface 38 ensures that the door can be closed. However, it is clear that a lateral force is exerted onto the keeper 8, 9 when the bolt 32 impacts the inclined surface 38. This lateral force is also transmitted to the lock lever 39 and the bearing element 48 avoids that this force would be entirely transmitted to the shaft portions 70, 71 which could thereby be damaged.

Furthermore, in other embodiments, the bearing element 48 may be a protrusion, e.g., a circular pin, that is positioned into a corresponding opening in the lock lever 39. In other words, the bearing element 48 is not necessarily positioned between the protrusions 42, 68 of the lock lever 39.

It will be further appreciated that, in other embodiments, two bearing elements may also be provided, a first bearing element for the first keeper 9 and a second bearing element for the second keeper 8.

In the illustrated embodiments, the strike 1 is fail-secure, e.g., when there is a power failure or the electromagnet 49 is defected, the lock lever 39 remains in the door-locking position by the compression spring 46 thereby keeping the door locked.

It will be appreciated that the strike 1 may also be manufactured as fail-safe, e.g., when there is a power failure or the electromagnet 49 is defected, the lock lever 39 remains in the door-releasing position thereby keeping the door open. This may be done in a number of ways.

A first fail-safe embodiment is illustrated in FIGS. 23 to 29 that show a fail-safe strike 1 holding a latch bolt 32 of a door lock 2 in two positions: the lock lever 39 in the locking position and the keeper 9 in the door-locking position (FIGS. 23 to 25); and the lock lever 39 in the unlocking position and the keeper 9 in the door-releasing position (FIGS. 26 to 29).

Figure 25:
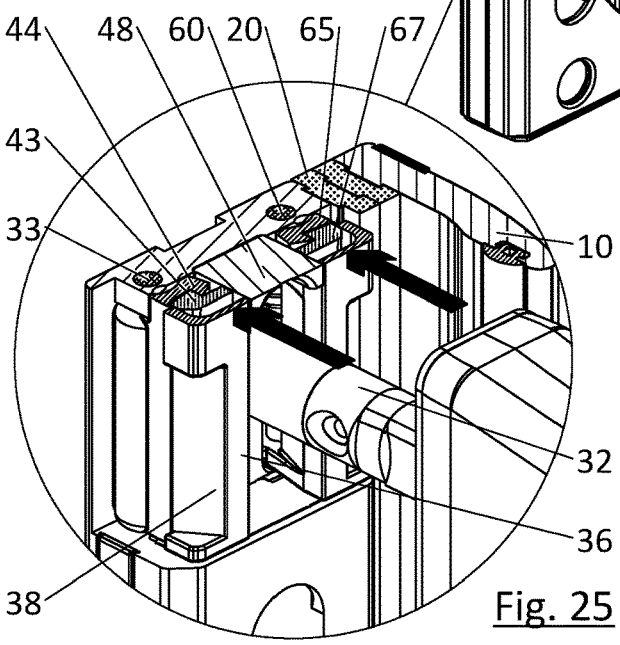
FIG. 25 shows, on a larger scale, a detail of the door lock and the strike of FIG. 24.

In this embodiment, the interlocking elements 44, 65 of the respective keepers 8, 9 are formed by hook-shaped elements that are closer to, when compared with the fail-secure embodiment described with respect to FIGS. 1 to 22, the shafts 33, 60 of the respective keepers 8, 9. The hook-shaped element of a keeper 8, 9 forms a recess 45, 66 (clearly visible in FIG. 28) into which a hook-shaped element 43, 67 of the lock lever 39 fits (as illustrated in FIG. 25). Compared to the fail-secure embodiment, the hook-shaped elements on the keepers 8, 9 and the lock lever 39 are now directed in the opposite directions. Moreover, the hook-shaped elements on the keepers 8, 9 are now situated behind, instead of in front of, the hook-shaped elements of the lock lever 39. When these interlocking elements 43, 44, 65, 67 interlock with one another, as depicted in FIG. 25, the keepers 8, 9 are unable to rotate around their respective shafts 33, 60 thereby keeping the keeper 8, 9 in its door-locking position.

Figure 23:
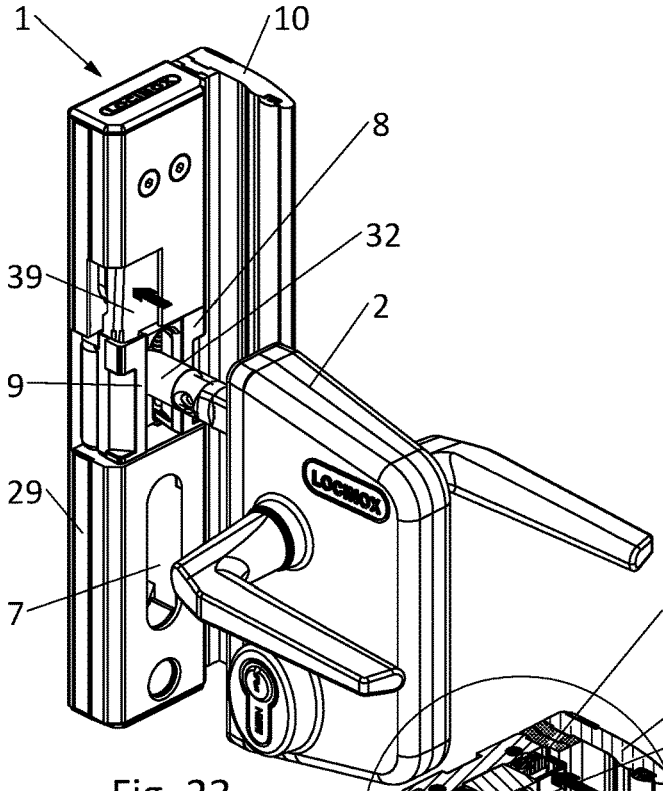
FIG. 23 shows a perspective view of one representative embodiment of a strike holding a latch bolt of a door lock in the door-locking position with a section of the front cover of the strike having been removed to see details on the lock lever and the keeper, in accordance with aspects of the present disclosure.
Figure 24:
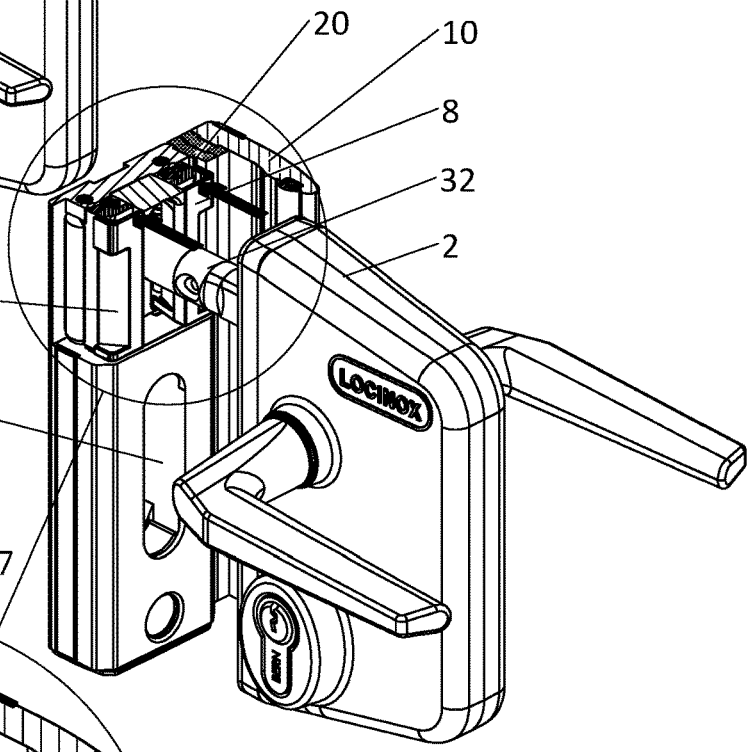
FIG. 24 shows a perspective view with a transverse cross-section through the strike of FIG. 23.
Figure 26:
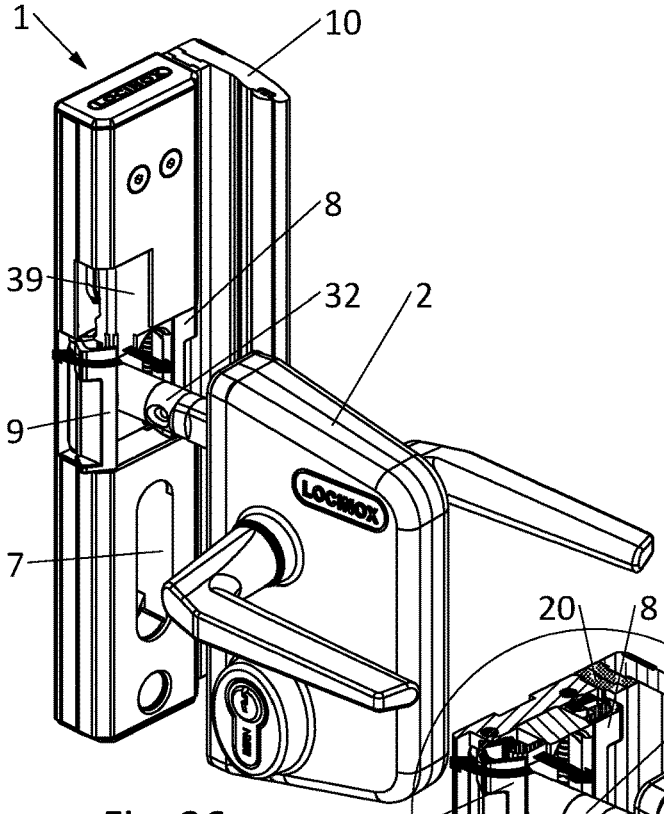
FIGS. 26 to 28 are similar views to FIGS. 23 to 25, but showing the first alternative embodiment of the strike holding a latch bolt of a door lock in the door-releasing position with the lock lever in its unlocking position.
Figure 27:
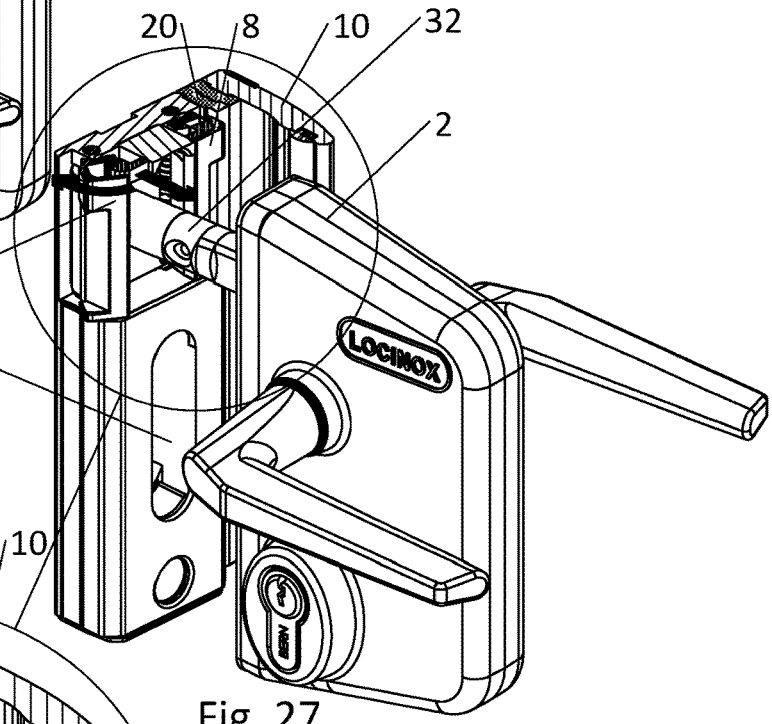
Figure 28:
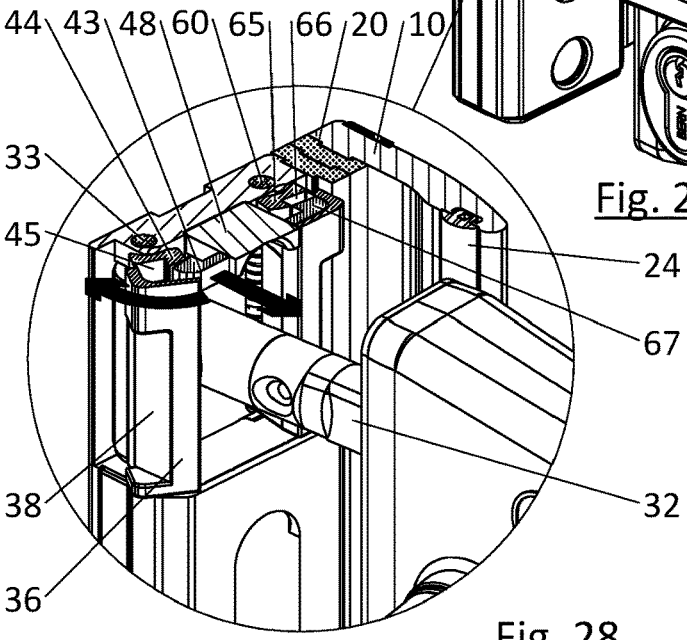
Figure 29:
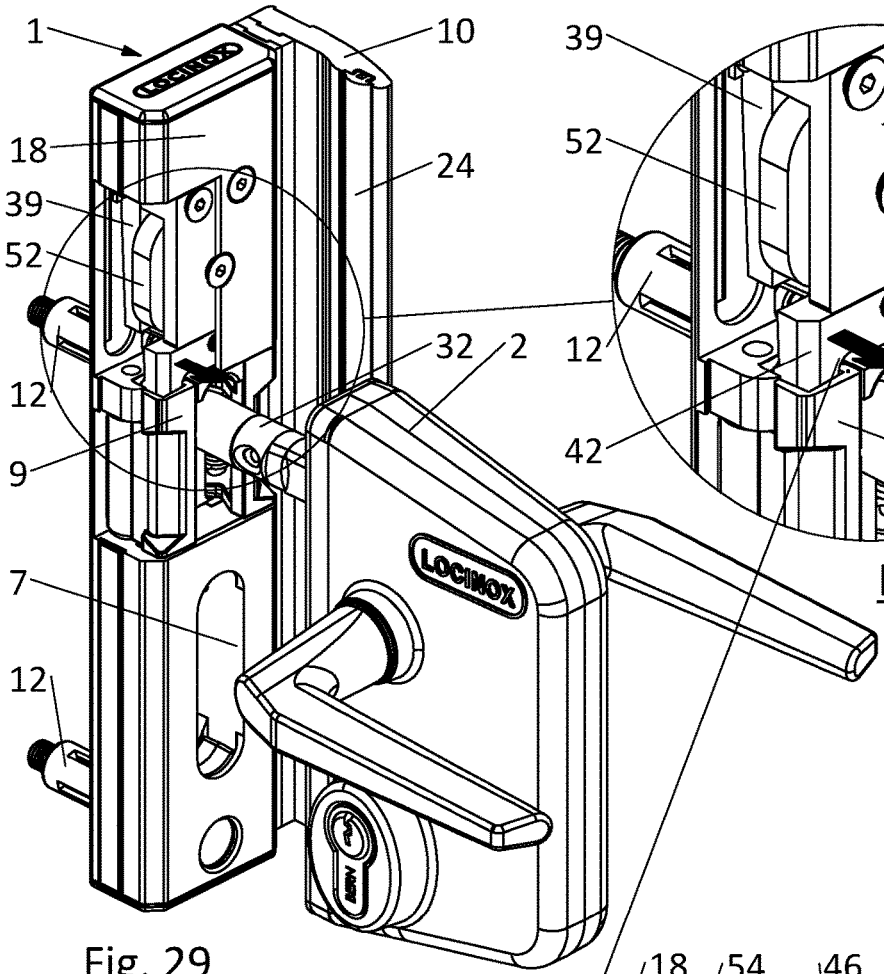
FIG. 29 shows a perspective view of one representative embodiment of a strike holding a latch bolt of a door lock in the door-releasing position with a section of the front cover of the strike having been removed to see details on the lock lever and the keeper, in accordance with aspects of the present disclosure.
Figure 30:
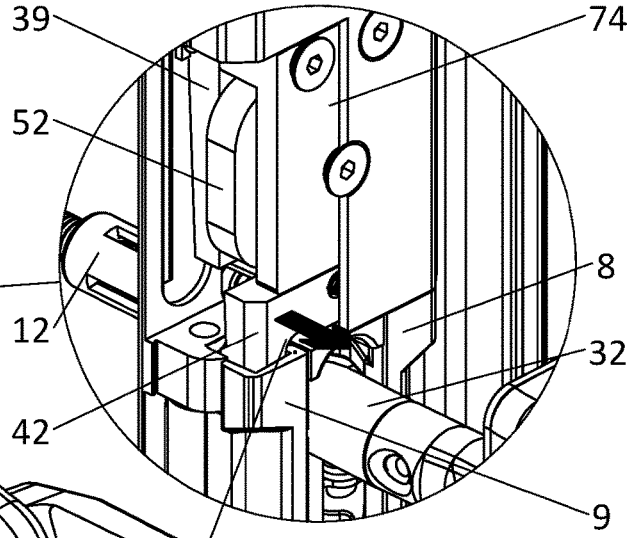
FIG. 30 shows, on a larger scale, a detail of the door lock and the strike of FIG. 29.
Figure 35:
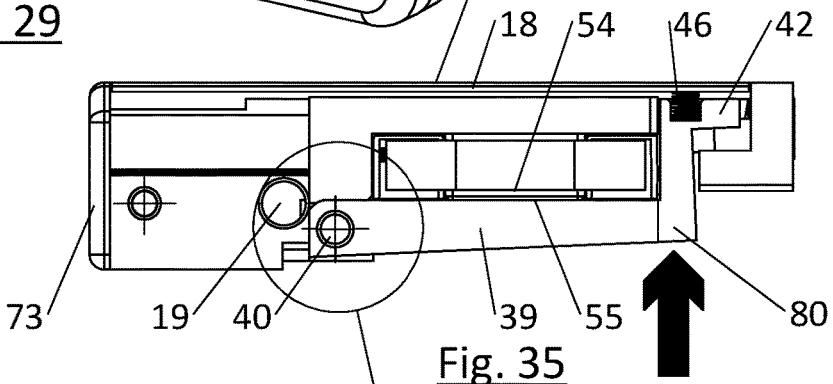
Figure 36:
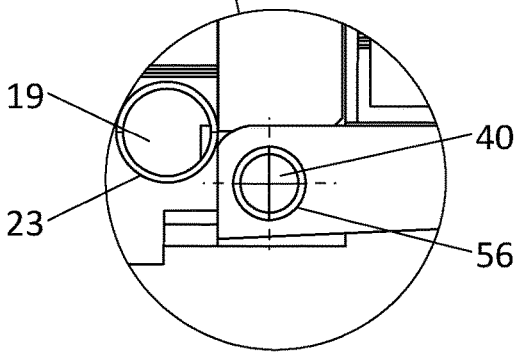

The black arrows in FIGS. 23 to 25 indicate the direction of force exerted onto the lock lever 39 by the energized electromagnet 49, which electromagnet 49 is identical to the electromagnet 49 described above with respect to FIGS. 1 to 22. In other words, when the electromagnet 49 is energized, the lock lever 39 is attracted and moves against the force of the compression spring 46 to its locking position. When the electromagnet 49 is turned off, the compression spring 46 urges the lock lever 39 away from the electromagnet 49 (as indicated by the straight black arrows in FIGS. 26 to 28). As such, the interlocking elements 43, 44, 65, 67 disengage and the keepers 8, 9 are free to pivot about their respective shafts 33, 60 as illustrated in FIGS. 26 to 28 with the curved black arrows.

Besides varying the position and orientation of the interlocking elements, it is also possible to provide a fail-safe strike by changing the configuration of the electromagnet 49 and the lock lever 39.

Figure 37:
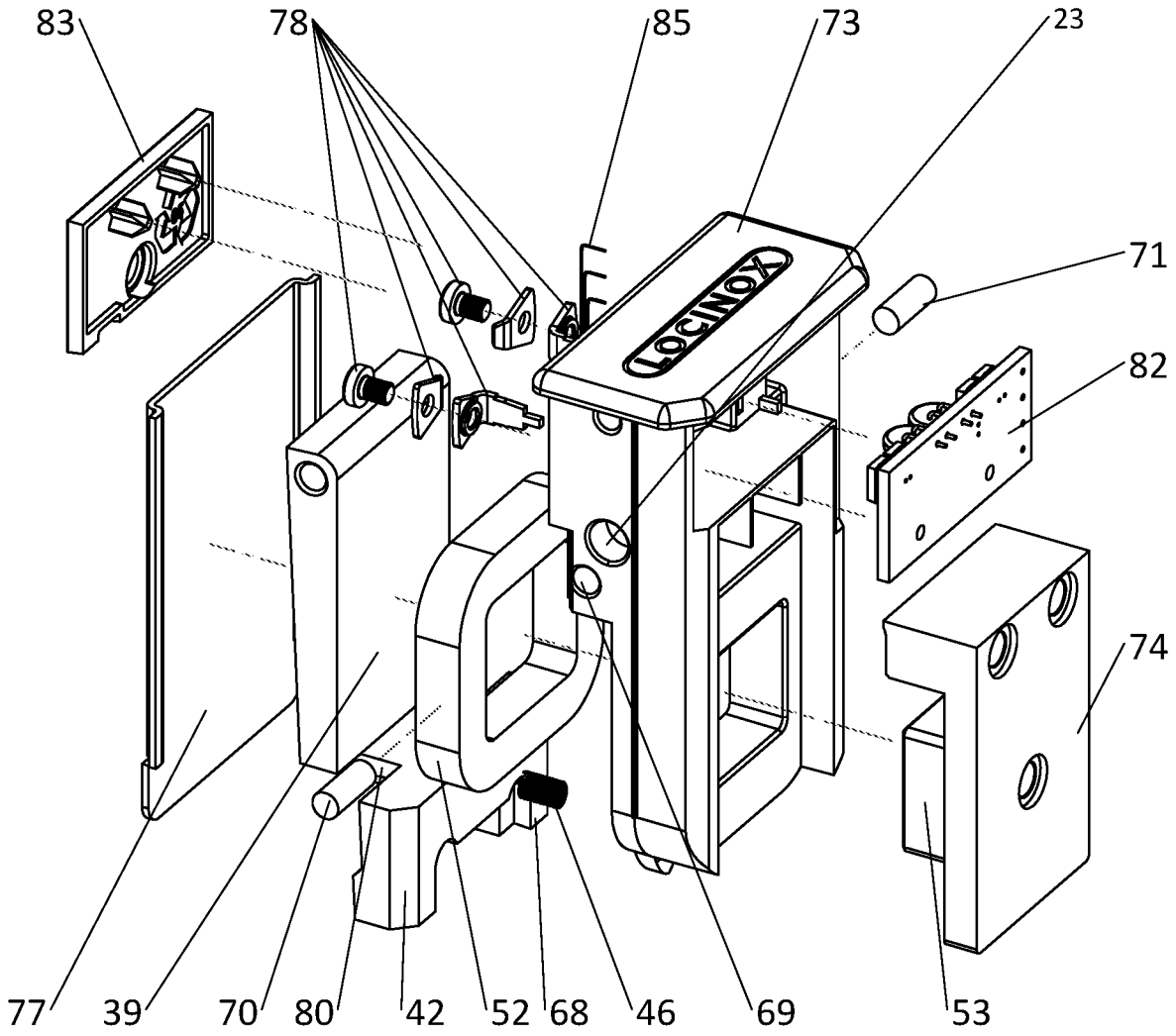
FIG. 37 is similar to FIG. 21, showing an exploded view of the top part of the alternative embodiment of the strike illustrated in FIGS. 29 to 36.

Such an embodiment of a fail-safe strike 1 is illustrated with respect to FIGS. 33 to 37. FIG. 37 illustrates an exploded view of the top part of this embodiment of the strike 1. The main differences with the embodiment of the strike illustrated in FIGS. 1 to 22 is that the slab 74 which also forms the core 53 of the electromagnet 49 is now located at the front of the strike 1 with the lock lever 39 being located at the back of the strike 1 near the covering element 77. In order to avoid having to modify the position and orientation of the interlocking elements 43, 44, 65, 67 on the keepers 8, 9 and the lock lever 39, the lock lever is provided with a bridge element 80 that enables the protrusions 42, 68 to be located again near the front of the strike 1. Because the protrusions 42, 68 are located at the front, and because the location of the lock lever 39 and of the electromagnet 49 have been switched, there is no need to change the structure of the interlocking elements 43, 44, 65, 67.

FIGS. 29 to 32 illustrate the door-releasing position when the electromagnet 49 is not energized. As before, there is a gap 57 present between the surface 54 of the core 53 and the lock lever 39 because the compression spring 46, fixed in a hole 47 in the protrusion 42, urges the lock lever 39 away from the frame 18 and towards the back side of the strike 1. When the electromagnet 49 is energized (as illustrated in FIGS. 33 to 36), the lock lever 39 is attracted against the force of the compression spring 46 to move the protrusion 42 towards the front of the strike 1 thereby interlocking the interlocking elements 43, 44, 65, 67 in the same way as illustrated in FIGS. 11 and 12.

This fail-safe embodiment has the advantage that smaller forces are exerted onto the keepers 8, 9 and the lock lever 39 as the distance between the first shaft 33 and the point at which the elements 43, 44 interlock is larger, and thus the lever effect is smaller, as compared to the embodiment illustrated in FIGS. 23 to 28.

In another alternative embodiment (not illustrated), the core 53 may be located to one side with respect to the plane $\alpha$ (illustrated in FIGS. 9 and 17) and the keepers 8, 9 may be located to the other side with respect to the plane $\alpha$ when compared to the fail-secure embodiment described with respect to FIGS. 1 to 22. In other words, the electromagnet 49 may be placed above the second pivot axis 41 with the compression spring 46 then also being located above the second pivot axis 41, e.g., away from the keepers 8, 9. In this way, when the keepers 8, 9 and the lower part of the lock lever 39 have the same interlocking elements 43, 44, 65, 67 as in the fail-secure embodiment, the compression spring 46 will urge the top part of the lock lever 39 away from the electromagnet 49 and the lower part, e.g., the part of the lock lever 39 below the second pivot axis 41, being urged towards the back of the strike 1 ensuring that the interlocking elements 43, 44, 67, 68 do not interlock with one another thereby leaving the keepers 8, 9 in the door-releasing position. When energizing the electromagnet 49 the top part of the lock lever 39 will be attracted and the lower part will move towards the keeper 8, 9 thereby interlocking the interlocking elements 43, 44, 67, 68.

Advantageously, in each of these fail-safe embodiments, there is no need to have a moveable core of the electromagnet 49.

It will be appreciated that, although two keepers 8, 9 were provided for the latch bolt cavity 6, in other embodiments only a single keeper may be provided that forms a single side wall of the latch bolt cavity 6.

It will be appreciated that, although the keepers 8, 9 with the lock lever 39 and electromagnet 49 have been described with respect to the latch bolt cavity 6, in other embodiments one or more keepers may also be used to form one or more side walls of the dead bolt cavity 7. In some embodiments, the corresponding lock lever 39 and electromagnet 49 may then be placed below the dead bolt cavity 7.

It will be further appreciated that there may also be two pairs of keepers, each pair having a lock lever with a corresponding electromagnet to independently control the latch bolt cavity 6 and the dead bolt cavity 7.

Furthermore, it is also possible to provide a strike 1 with two keepers 8, 9 and a single lock lever 39 that only operates one of the keepers 8, 9. For example, the lock lever 39 may only have single protrusion 42. In order for the strike 1 to be useable for both right-handed and left-handed closure members, the lock lever 39 needs to be manually reversed. This may be done by removing the shaft portions 70, 71 and by flipping the lock lever 39 before inserting the shaft portions 70, 71 again.

It will be appreciated that, although the lock lever 39 has been described as being pivotably attached to the strike frame 18 by the second shaft 40, in other embodiments, a slideable lock lever 39 may also be implemented in the strike 1.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A surface mountable electric strike having a bolt cavity arranged to receive a bolt of a door lock, the electric strike comprising:

a strike frame;

a keeper mounted on the strike frame, the keeper forming a side wall of said bolt cavity and being arranged to pivot about a first pivot axis extending in a first direction, between a door-locking position, wherein the keeper is arranged to retain the bolt to prevent door opening, and a door-releasing position, wherein the keeper is arranged to enable the bolt to exit the bolt cavity along a second direction substantially perpendicular to said first direction;

a lock lever mounted on the strike frame for locking the keeper in said door-locking position, the lock lever being arranged to pivot about a second pivot axis extending substantially in said second direction, between a locking position, wherein the keeper, when in said door-locking position, is prevented by the lock lever from pivoting around the first pivot axis to said door-releasing position, and an unlocking position, wherein the keeper is free to pivot around the first pivot axis to said door-releasing position, wherein the lock lever is mainly formed as a plate shaped portion only extending along said first direction, away from the second pivot axis, the plate shaped portion having a proximal end near the second pivot axis and a distal end, wherein the lock lever has a free extremity at its proximal end and comprises a first interlocking element located at the free extremity, which first interlocking element cooperates, when the lock lever is in said locking position and the keeper in said door-locking position, with a second interlocking element on the keeper to prevent the keeper from pivoting around the first pivot axis to said door-releasing position;

a biasing member to urge the lock lever to one of said locking and unlocking positions; and an electromagnet to pivot the lock lever to the other one of said locking and unlocking positions, said electromagnet comprising a solenoid with a fixed core situated next to the lock lever, wherein the electromagnet is oriented to produce a magnetic field that is, inside the solenoid, directed substantially in a third direction which is substantially perpendicular to both the first direction and the second direction to magnetically attract the lock lever.

2. The electric strike of claim 1, wherein, when the electromagnet is energized, the fixed core of the electromagnet couples to a portion of the surface of the lock lever, while, when the electromagnet is not energized, a gap is present between the fixed core and said portion of the surface of the lock lever.

3. The electric strike of claim 2, wherein the lock lever has a free extremity with said portion of the surface of the lock lever being located between the second pivot axis and the free extremity.

4. The electric strike of claim 1, wherein the lock lever further comprises:

a bridge element having a proximal end that is joined to the distal end of the plate shaped portion, the bridge element extending substantially along said third direction and having a distal end; and an end portion joined to the distal end of the bridge element and forming a free extremity of the lock lever.

5. The electric strike of claim 1, wherein said at least one biasing member urges the lock lever to said locking position and, when said electromagnet is energized, the electromagnet magnetically attracts the lock lever to pivot from said locking position to said unlocking position.

6. The electric strike of claim 1, wherein the keeper has a free extremity, the second interlocking element being located at the free extremity of the keeper.

7. The electric strike of claim 1, wherein the strike frame is provided with a bearing element arranged to bear against the lock lever to prevent the lock lever, when the lock lever is in its locking position and when the keeper is in its door-locking position, from being moved in said second direction when said bolt of the door lock is urged against the keeper.

8. The electric strike of claim 7, wherein the bearing element is configured to bear against the lock lever at the free extremity of the lock lever.

9. The electric strike of claim 1, wherein the electric strike comprises a further keeper mounted on the strike frame, the further keeper forming a further side wall of said bolt cavity, the further side wall being opposite to said side wall of the bolt cavity, the further keeper being arranged to pivot about a third pivot axis substantially parallel to said first pivot axis, between a door-locking position, wherein the further keeper is arranged to retain the bolt to prevent door opening, and a door-releasing position, wherein the further keeper is arranged to enable the bolt to exit the bolt cavity in a direction opposite to said second direction.

10. The electric strike of claim 9, wherein in the door-locking position of the further keeper, the further keeper is prevented by said lock lever, in the locking position thereof, from pivoting around said third pivot axis to the door-releasing position and is free to pivot around said third pivot axis to the door-releasing position in the unlocking position of the lock lever.

11. The electric strike of claim 9, wherein the lock lever further comprises a third interlocking element located at said free extremity, the third interlocking element cooperating, when the lock lever is in said locking position and the further keeper in its door-locking position, with a fourth interlocking element on said further keeper to prevent said further keeper from pivoting around said third pivot axis to its door-releasing position.

12. The electric strike of claim 11, wherein the keeper and the further keeper each have a free extremity with said second interlocking element being situated near the free extremity of said keeper and with said fourth interlocking element being situated near the free extremity of said further keeper.

13. The electric strike of claim 9, wherein the electric strike further comprises a door stop that is mountable to the strike frame on a first side of the electric strike when the keeper has to co-operate with said bolt and on a second side of the electric strike when the further keeper has to co-operate with said bolt.

* * * * *